US006865363B2

(12) United States Patent
Hachisuka et al.

(10) Patent No.: US 6,865,363 B2
(45) Date of Patent: Mar. 8, 2005

(54) METHOD AND APPARATUS FOR IMAGE FORMING CAPABLE OF EFFECTIVELY PERFORMING AN IMAGE FIXING PROCESS

(75) Inventors: Toshiharu Hachisuka, Kanagawa-ken (JP); Masamichi Yamada, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 10/285,440

(22) Filed: Nov. 1, 2002

(65) Prior Publication Data

US 2003/0053830 A1 Mar. 20, 2003

Related U.S. Application Data

(62) Division of application No. 09/727,525, filed on Dec. 4, 2000, now Pat. No. 6,577,840.

(30) Foreign Application Priority Data

Dec. 2, 1999 (JP) ..... 11-343340
Mar. 21, 2000 (JP) ..... 2000-078330

(51) Int. Cl.[7] ..... G03G 15/20
(52) U.S. Cl. ..... 399/329; 219/216; 399/328
(58) Field of Search ..... 219/216; 399/320, 399/324, 328, 329

(56) References Cited

U.S. PATENT DOCUMENTS 5,250,996 A * 10/1993 Sugizaki et al. ..... 399/328
6,243,559 B1 * 6/2001 Kurotaka et al. ..... 399/329

* cited by examiner

*Primary Examiner*—Hoang Ngo
(74) *Attorney, Agent, or Firm*—Oblon, Spivak, McClelland, Maier & Neustadt, P.C.

(57) ABSTRACT

A fixing apparatus includes a fixing roller, a heat roller, a seamless fixing belt, a pressure roller, a supporting roller, and a pressure applying member. The heat roller includes a fixing heat source. The seamless fixing belt is extended between the fixing roller and the heat roller. The pressure roller pushes the fixing roller via the fixing belt to form a second fixing-process area. The supporting roller contacts inside the fixing belt and winds the fixing belt around a surface of the pressure roller to form a first fixing-process area upstream of and next to the second fixing-process area. The pressure applying member applies a pressure to the heat roller in a direction opposite to an ejection of the recording sheet from the second fixing-process area to adjust a fixing pressure of the first fixing-process area.

13 Claims, 19 Drawing Sheets

METHOD AND APPARATUS FOR IMAGE FORMING CAPABLE OF EFFECTIVELY PERFORMING AN IMAGE FIXING PROCESS

CROSS-REFERENCE TO RELATED APPLICATIONS

This application claims priority to Japanese patent application Nos. JPAP2000-078330 filed on Mar. 21, 2000 and JPAP11-343340 filed on Dec. 2, 1999 in the Japanese Patent Office, the entire contents of which are hereby incorporated by reference.

BACKGROUND OF THE INVENTION

1. Field of the Invention

The present invention relates to a method and apparatus for image forming, and more particularly to a method and apparatus for image forming that is capable of effectively performing an image fixing process.

2. Description of the Related Arts

Conventionally, a fixing station for use in an image forming apparatus employs a heat roller mechanism in which a fixing roller having a heat source and a pressure roller for applying a pressure to the fixing roller are provided so as to form a fixing nip through which a recording sheet is conveyed and is subjected to a fixing process. In such a heat roller mechanism, from its structure, the melted toner is inevitably separated from the fixing roller before it is sufficiently cooled off. Accordingly, an offset phenomenon is prone to be caused in which the toner is erroneously deposited on the surface of the fixing roller.

In recent years, a belt-type fixing mechanism capable of allowing the toner to sufficiently cool off has been looked at and various proposals associated with the belt-type fixing mechanism have been made.

In a Published Unexamined Japanese Patent Application No. 6-318001 (1994), one example of a belt fixing mechanism is disclosed, in which a seamless fixing belt is extended and is rotated between a heat roller internally having a heat source such as a halogen heater and a fixing roller, and a pressure roller is arranged to push the fixing belt against the fixing roller so as to form a fixing nip between the pressure roller and the fixing belt. In this mechanism, the toner is melted by a heat of the fixing belt heated by the heat roller, and the processes of fixing and cooling are performed at the fixing nip located downstream from the heat roller. The feature of this example is that, in order to prevent the offset phenomenon by reducing a temperature of the fixing nip, a recording sheet is made close to the fixing belt and is guided to the fixing nip so as to be sufficiently heated before reaching the fixing nip.

In general, the fixing belt of the belt-type fixing mechanism has a far smaller heat capacity than the fixing roller of the roller type fixing mechanism and, therefore, the fixing belt can rapidly be cooled off during the time when it is moved to pass through the fixing nip, resulting in an accurate prevention of the offset phenomenon.

On the other hand, this mechanism has a drawback that a sufficient fixing heat capacity cannot be obtained because of the small heat capacity of the fixing belt.

A Published Unexamined Japanese Patent Application No. 9-160405 (1997) discloses a technique which attempts to solve the above-mentioned problem. In this technique, a pre-nip is additionally formed at an entrance of an ordinary fixing nip formed by a pressure applied to the fixing roller by the pressure roller. The pre-nip is formed by winding the fixing belt around the pressure roller with a supporting roller arranged inside the fixing belt. Accordingly, the entire nip length is extended and, thereby, the recording sheet can contact the fixing belt for a longer time period so that a sufficient heat will be transferred onto the recording sheet.

When the velocities at which the recording sheet is conveyed in the image forming apparatus and in the fixing station are different, in particular, when the velocity at the fixing station side is relatively slower, the recording sheet may be slacked and tends to touch various portions of the fixing station. As a result of this touching, the surface of the toner image which is not fixed may be rubbed and the toner image may be damaged. This is often called an image rubbing phenomenon.

In the technique described in the above-mentioned Published Unexamined Japanese Patent Application No. 9-160405 (1997), in which the length of the fixing nip is made longer than usual, the recording sheet has a risk of touching the fixing belt before entering the fixing nip. This mechanism is explained below with reference to FIG. 1.

FIG. 1 shows a schematic representation of a belt-type fixing station which includes a fixing roller 100, a heat roller 104 internally having a halogen heater 102, and a fixing belt 106 extended between the fixing roller 100 and the heat roller 104. The fixing station further includes a pressure roller 108 for applying a pressure to the fixing roller 100 via the fixing belt 106 and a guide member 110 for guiding an incoming recording sheet 112 having an unfixed toner image on the surface thereof to a nip portion which is formed at an area where the fixing belt 106 and the pressure roller 108 are in contact under pressure. This nip portion is referred to as a fixing-process area N. The fixing-process area N is composed of a fixing-process area N1 and a fixing-process area N2. The area N1 is formed upstream from the area N2, which is the fixing-process area commonly used.

In the fixing station shown in FIG. 1, an entrance of the fixing-process area N is inevitably formed narrower because of the formation of the fixing-process area N1. If the recording sheet 112 is slacked, the surface of the unfixed toner image contacts the fixing belt 106.

In the type of fixing station illustrated in FIG. 2, when the recording sheet 112 is released at its trailing edge from transfer rollers (not shown) and becomes free during the time when the leading edge of the recording sheet 112 passes through the fixing-process area N, the recording sheet 112 is raised towards a tangent line A due to the stiffness of the recording sheet. This is referred to as a trailing edge rise phenomenon. With the trailing edge rise, the recording sheet 112 tends to contact the fixing belt 106 and, as a result, the image rubbing phenomenon is caused. Of course, a thicker recording sheet tends to cause more of a trailing edge rise than with an ordinary recording sheet.

Another example of the belt-type fixing station is described in a Published Unexamined Japanese Patent Application No. 9-90787 (1997), in which a seamless fixing belt is rotatably extended between a heat roller internally having a heat source and a fixing roller having an elastic layer, and a hard-structured pressure roller is arranged to push the fixing belt against the fixing roller so that a fixing nip is formed between the pressure roller and the fixing belt.

With this mechanism, the toner is melted by the heat of the fixing belt heated by the heat roller, and the processes of fixing and cooling are performed at the fixing nip located downstream from the heat roller.

Also, the elastic layer of the fixing roller is configured to have a heat-insulating function for protecting the fixing belt from losing unnecessary heat, as well as an elastically-deforming function for enlarging the fixing nip, having a thickness of at least 2 mm.

From the structure of the fixing station described in the above-mentioned Published Unexamined Japanese Patent Application No. 9-90787 (1997), it is understood that many of the belt-type fixing stations use a fixing roller having an elastic layer as well as a main driving roller for conveying a recording sheet. Also, it is understood that in many cases the position of the fixing roller is fixed in the fixing station because the driving force can easily be transmitted from an image forming apparatus to the fixing station.

However, when a fixing roller having a thick elastic layer is used as a main driving roller, a radius of the fixing roller measured from the center of the rotation axis to the fixing nip varies in an area between the leading and trailing edges due to deformation of the elastic layer and, therefore, it is difficult to reproduce the linear velocity of the fixing roller. Furthermore, the layer combining the elastic property and the heat-insulating property is prone to be worn and be deteriorated over time and, therefore, the linear velocity of the fixing roller becomes unstable. That is, the linear velocity can be known only when the fixing station actually operates and cannot be calculated. Therefore, the linear velocity of the fixing station cannot be specified during the design stage.

In addition, when the fixing roller located inside the fixing belt is used as a main driving roller, there is a risk of a slip occurring between the fixing roller and the fixing belt and, if the slip occurs, the linear velocity of the fixing roller is inhibited.

Another example of the belt-type fixing station is described in a Published Unexamined Japanese Patent Application No. 11-24486 (1999), in which a hard-structured pressure roller is applied with a force using a spring to push a fixing belt against a position-fixed fixing roller having an elastic layer so as to form a fixing nip between the fixing belt and the pressure roller. In this mechanism, the pressure roller is used also as a main driving roller. That is, such a roller as the pressure roller located outside the fixing belt is used as the main driving roller.

With this mechanism, the fixing nip is formed with deformation of the elastic layer of the fixing roller, which is not new, but the linear velocity of the fixing station may not be adversely affected by the slip occurring between the fixing roller and the fixing belt. Because the hard-structured pressure roller is used as a main driving roller for conveying the recording sheet, the linear velocity is highly stable. Therefore, the technique described in the Published Unexamined Japanese Patent Application No. 11-24486 (1999) can solve the drawbacks of the technique described in the Published Unexamined Japanese Patent Application No. 9-90787 (1997).

In the mechanism described in the Published Unexamined Japanese Patent Application No. 11-24486 (1999), the pressure and main-driving roller is movable in the direction of the thickness of the recording sheet orthogonal to the sheet transfer direction and a rotation force from a driving source is input to the pressure and main-driving roller from one side of the rotation axis of the pressure and main-driving roller. Therefore, the pressure varies in the direction of the axis of the pressure and main-driving roller depending upon the driving torque. As a result, the technique has numerous drawbacks such as generating wrinkles, an uneven glossy finish, a faulty fixing, an offset problem, etc.

FIG. 3 shows a schematic representation of a typical belt-type fixing station, such as the one described in the above-mentioned Published Unexamined Japanese Patent Application No. 11-24486. In this mechanism, a recording sheet 700 having an image is guided by a guide plate 702 such that the leading edge of the recording sheet 700 is guided to the surface of a hard-structured pressure roller 704 and is conveyed into a fixing nip area N.

However, in this mechanism in which the pressure roller 704 is applied with a force using a spring or the like to push a fixing belt 710 against the fixing roller 706 so as to form the fixing nip N between the pressure roller 704 and the fixing belt 710, there is a risk of displacement of the center of the pressure roller 704 from a position $C_0$ to a position $C_1$, as shown in FIG. 3, due to an elastic layer 708 of the fixing roller 706 which wears over time. In this case, an angle for the recording sheet 700 to approach is changed from $\theta_0$ to $\theta_1$ and therefore an entrance of the fixing nip N becomes narrow. As a result, the recording sheet 700 may be more prone to be jammed.

This jam problem caused by the change of the approach angle occurs also in the roller-type fixing station. In comparison with the structure of the belt-type fixing station shown in FIG. 3, the roller-type fixing station commonly has a structure in which the pressure roller having an elastic layer is arranged under the hard-structured fixing roller, in the case of fixing a mono-chrome image. In this structure, the elastic layer of the pressure roller is worn over timer and, therefore, the center of the pressure roller is moved towards the fixing roller. Therefore, when the leading edge of the recording sheet is guided by the pressure roller into the fixing nip, the above-mentioned jam problem may occur due to the change of the angle.

The fixing station using the fixing belt is described in various other publications including Published Unexamined Japanese Patent Application Nos. 8-137306 (1996), 4-273279 (1992), and 4-362984 (1992).

SUMMARY OF THE INVENTION

The present invention provides a novel fixing apparatus for use in an image forming apparatus. In one example, a novel fixing apparatus includes a fixing roller, a heat roller, a seamless fixing belt, a pressure roller, a supporting roller, and a pressure applying member. The heat roller includes a fixing heat source. The seamless fixing belt is extended between the fixing roller and the heat roller. The pressure roller is configured to push the fixing roller via the fixing belt so as to form a second fixing-process area. The supporting roller is configured to contact inside the fixing belt and to wind the fixing belt around a surface of the pressure roller so as to form a first fixing-process area upstream of and next to the second fixing-process area. The pressure applying member is configured to apply a pressure to the heat roller in a direction opposite to an ejection of the recording sheet from the second fixing-process area so as to adjust a fixing pressure of the first fixing-process area.

The present invention further provides another novel fixing apparatus for use in an image forming apparatus. In one example, a novel fixing apparatus includes a receiving roller, a fixing roller, a heat source, and a driving source. The receiving roller is configured to rotate around a rotation axis fixed at a position. The fixing roller is configured to apply a pressure to the receiving roller so that a fixing nip area is formed between the fixing roller and the receiving roller, and includes an elastic layer. The heat source is configured to apply a heat to a recording sheet carrying an image on a surface thereof. The driving source is configured to drive at least one of the fixing roller and the receiving roller to rotate. In this fixing apparatus, the recording sheet is conveyed to the fixing nip area in an orientation in which the surface carrying the image faces the fixing roller and another surface of the recording sheet carrying no image faces the receiving roller.

The receiving roller may have a structure resistant to deformation in comparison with a structure of the fixing roller, and the recording sheet may be guided at its leading edge by a surface of the receiving roller to enter the fixing nip area.

The receiving roller may include a hard-metal core and a high-release elastic layer covering the hard-metal core.

The receiving roller may be driven for rotation by the driving source and the fixing roller may follow a rotation of the receiving roller.

The above-mentioned fixing apparatus may further include a pressure applying member configured to apply a pressure to the fixing roller so that the fixing roller pushes the receiving roller.

The above-mentioned fixing apparatus may further include a stopper configured to stop at a predetermined position the fixing roller being moved towards the receiving roller by the pressure applying member.

The present invention further provides a novel fixing apparatus for use in an image forming apparatus. In one example, a novel fixing apparatus includes a receiving roller, a fixing roller, a fixing belt, a heat source, and a driving source. The receiving roller is configured to rotate around a rotation axis fixed at a position. The fixing roller is configured to comprise an elastic layer. The fixing belt is configured to be wound around a surface of the fixing roller and to receive a pressure via the fixing roller to push the receiving roller so that a fixing nip area is formed between the fixing belt and the receiving roller. The heat source is configured to apply a heat to the fixing belt. The driving source is configured to drive the receiving roller for rotation. In this fixing apparatus, the receiving roller has a structure resistant to deformation in comparison with a structure of the fixing roller and a recording sheet carrying an image on a surface thereof is conveyed to the fixing nip area in an orientation in which the surface carrying the image contacts the fixing belt and another surface of the recording sheet carrying no image contacts the receiving roller.

The present invention further provides a novel fixing apparatus for use in an image forming apparatus. In one example, a novel fixing apparatus includes a receiving roller, a fixing roller, a fixing belt, a first heat source, and a driving source. The receiving roller is configured to rotate around a rotation axis fixed at a position. The fixing roller is configured to comprise a heat-insulating hard-elastic layer. The fixing belt is configured to be wound around a surface of the fixing roller and to receive a pressure via the fixing roller to push the receiving roller so that a fixing nip area is formed between the fixing belt and the receiving roller. The first heat source is configured to apply a heat to the fixing belt. The driving source is configured to drive the receiving roller for rotation. In this fixing apparatus, the receiving roller has a structure resistant to deformation in comparison with a structure of the fixing roller and the fixing roller includes a second heat source. Further, a recording sheet carrying an image on a surface thereof is conveyed to the fixing nip area in an orientation in which the surface carrying the image contacts the fixing belt and another surface of the recording sheet carrying no image contacts the receiving roller.

The receiving roller may include a hard-metal core and a high-release elastic layer covering the hard-metal core.

The above-mentioned fixing apparatus may further include at least two supporting rollers arranged inside the fixing belt to support the fixing belt together with the fixing roller. In this fixing apparatus, the above-mentioned at least two supporting rollers, the fixing roller, and the fixing belt are unified into one fixing unit which is held for a turning movement about a rotation axis of one of the above-mentioned at least two supporting rollers which is located upstream from the fixing nip area in a direction of transferring the recording sheet. Further, the pressure received by the fixing roller is effectuated by the turning movement of the fixing unit.

The first heat source may be held inside another one of the above-mentioned at least two supporting rollers which is located further upstream from the one of the at least two supporting rollers in a direction of transferring the recording sheet. Further, an angle θ between a straight line of the fixing belt, where the straight line extends between the one roller having the rotation axis used for the turning movement of the fixing unit and another roller containing the first heat source therein, and a tangent line of the receiving roller at an entrance of the fixing nip area may be made in a range of from 15 degrees to 70 degrees.

The above-mentioned fixing apparatus may further includes a release agent coating member configured to coat the fixing belt with a release agent, wherein the release agent coating member is unified into the fixing unit.

The above-mentioned fixing apparatus may further include a pressure applying member configured to generate the pressure to be applied to the fixing roller and the fixing belt to push the receiving roller.

The above-mentioned fixing apparatus may further include a stopper configured to stop at a predetermined position the fixing roller and the fixing belt from both being moved towards the receiving roller by the pressure applying member.

The above-mentioned fixing apparatus may further include a pressure release member configured to release the pressure.

The above-mentioned fixing apparatus may further include a release agent coating member configured to contact a surface of the receiving roller to coat the receiving roller with a release agent and to move away from the receiving roller, wherein the release agent coating member is moved away from the receiving roller when the recording sheet carries an image on a surface thereof.

Further, the present invention provides a novel fixing method for use in an image forming apparatus. In one example, a novel fixing method includes the steps of fixing, applying, driving, conveying, and performing. The fixing step fixes at a position a rotation axis of a receiving roller having a deformation-resistant structure. The applying step applies a pressure to a fixing roller to push the receiving roller so that a fixing nip area is formed between the fixing roller and the receiving roller. The driving step drives the receiving roller for rotation which the fixing roller follows. The conveying step conveys a recording sheet carrying an image on a surface thereof into the fixing nip area in an orientation in which the surface carrying the image faces the fixing roller and another surface of the recording sheet carrying no image faces the receiving roller. The performing step performs a fixing process with heat and pressure relative to the recording sheet.

Further, the present invention provides a novel fixing method for use in an image forming apparatus. In one example, a novel fixing method includes the steps of fixing, applying, driving, conveying, and performing. The fixing step fixes at a position a rotation axis of a receiving roller having a deformation-resistant structure. The applying step applies a pressure to a fixing roller and a fixing belt wound around a surface of the fixing roller to push the receiving roller so that a fixing nip area is formed between the fixing roller and the fixing belt. The driving step drives the receiving roller for rotation, which the fixing roller follows. The conveying step conveys a recording sheet carrying an image on a surface thereof into the fixing nip area in an orientation in which the surface carrying the image contacts the fixing belt and another surface of the recording sheet carrying no image contacts the receiving roller. The performing step performs a fixing process with heat and pressure relative to the recording sheet.

The above-mentioned fixing method may further include the steps of providing, unifying, holding, and turning. The providing step provides at least two supporting rollers inside the fixing belt to support the fixing belt together with the fixing roller. The unifying step unifies the above-mentioned at least two supporting rollers, the fixing roller, and the fixing belt into one fixing unit. The holding step holds the fixing unit for a turning movement about a rotation axis of one of the above-mentioned at least two supporting rollers which is located upstream from the fixing nip area in a direction of transferring the recording sheet. The turning step turns the fixing unit to apply the pressure to the fixing roller.

Further, the present invention provides a novel image forming apparatus. In one example, a novel image forming apparatus includes an image forming station, a sheet transfer mechanism, and a fixing station. The image forming station is configured to form an image on a recording sheet. The sheet transfer mechanism is configured to transfer the recording sheet carrying an image on a surface thereof. The fixing station is configured to perform a fixing process with heat and pressure. This fixing station includes a receiving roller, a fixing roller, a heat source, and a driving source. The receiving roller is configured to rotate around a rotation axis fixed at a position and to receive the recording sheet carrying an image on a surface thereof. The fixing roller is configured to apply a pressure to the receiving roller so that a fixing nip area is formed between the fixing roller and the receiving roller, the fixing roller comprising an elastic layer. The heat source is configured to apply heat to the recording sheet. The driving source is configured to drive at least one of the fixing roller and the receiving roller to rotate. In this fixing station, the recording sheet is conveyed to the fixing nip area in an orientation in which the surface of the recording sheet carrying the image faces the fixing roller and another surface of the recording sheet carrying no image faces the receiving roller.

The receiving roller may have a structure resistant to deformation in comparison with a structure of the fixing roller, and the recording sheet may be guided at its leading edge by a surface of the receiving roller to enter the fixing nip area.

The receiving roller may include a hard-metal core and a high-release elastic layer covering the hard-metal core.

The receiving roller may be driven for rotation by the driving source and the fixing roller may follow a rotation of the receiving roller.

The above-mentioned image forming apparatus may further include a pressure applying member configured to apply a pressure to the fixing roller so that the fixing roller pushes the receiving roller.

The above-mentioned image forming apparatus may further include a stopper configured to stop at a predetermined position the fixing roller being moved towards the receiving roller by the pressure applying member.

Further, the present invention provides an image forming apparatus. In one example, a novel fixing apparatus includes an image forming station, a sheet transfer mechanism, and a fixing station. The image forming station is configured to form an image on a recording sheet. The sheet transfer mechanism is configured to transfer the recording sheet carrying an image on a surface thereof. The fixing station is configured to perform a fixing process with heat and pressure. This fixing station includes a receiving roller, a fixing roller, a fixing belt, a heat source, and a driving source. The receiving roller is configured to rotate around a rotation axis fixed at a position and to receive the recording sheet carrying an image on a surface thereof. The fixing roller is configured to comprise an elastic layer. The fixing belt is configured to be wound around a surface of the fixing roller and to receive a pressure via the fixing roller to push the receiving roller so that a fixing nip area is formed between the fixing belt and the receiving roller. The heat source is configured to apply a heat to the fixing belt. The driving source is configured to drive the receiving roller for rotation. In this fixing station, the receiving roller has a structure resistant to deformation in comparison with a structure of the fixing roller and the recording sheet carrying an image on a surface thereof is conveyed to the fixing nip area in an orientation in which the surface carrying the image contacts the fixing belt and another surface of the recording sheet carrying no image contacts the receiving roller.

Further, the present invention provides a novel image forming apparatus. In one example, a novel image forming apparatus includes an image forming station, a sheet transfer mechanism, and a fixing station. The image forming station is configured to form an image on a recording sheet. The sheet transfer mechanism is configured to transfer the recording sheet carrying an image on a surface thereof. The fixing station is configured to perform a fixing process with heat and pressure. This fixing station includes a receiving roller, a fixing roller, a fixing belt, a first heat source, and a driving source. The receiving roller is configured to rotate around a rotation axis fixed at a position. The fixing roller is configured to comprise a heat-insulating hard-elastic layer. The fixing belt is configured to be wound around a surface of the fixing roller and to receive a pressure via the fixing roller to push the receiving roller so that a fixing nip area is formed between the fixing belt and the receiving roller. The first heat source is configured to apply a heat to the fixing belt. The driving source is configured to drive the receiving roller for rotation. In this fixing station, the receiving roller has a structure resistant to deformation in comparison with a structure of the fixing roller and the fixing roller includes a second heat source. Further, a recording sheet carrying an image on a surface thereof is conveyed to the fixing nip area in an orientation in which the surface carrying the image contacts the fixing belt and another surface of the recording sheet carrying no image contacts the receiving roller.

The receiving roller may include a hard-metal core and a high-release elastic layer covering the hard-metal core.

The above-mentioned fixing station may further include at least two supporting rollers arranged inside the fixing belt to support the fixing belt together with the fixing roller. In this fixing station, the above-mentioned at least two supporting rollers, the fixing roller, and the fixing belt are unified into one fixing unit which is held for a turning movement about a rotation axis of one of the above-mentioned at least two supporting rollers which is located upstream from the fixing nip area in a direction of transferring the recording sheet. Further, the pressure received by the fixing roller is effectuated by the turning movement of the fixing unit.

The first heat source may be held inside another one of the at least two supporting rollers which is located further upstream from the one of the at least two supporting rollers in a direction of transferring the recording sheet. Further, an angle θ between a straight line of the fixing belt, where the straight line extends between the one roller having the rotation axis used for the turning movement of the fixing unit and another roller inside containing the first heat source, and a tangent line of the receiving roller at an entrance of the fixing nip area is made in a range of from 15 degrees to 70 degrees.

In the above-mentioned image forming apparatus, the fixing station may further include a release agent coating member configured to coat the fixing belt with a lease agent, wherein the release agent coating member is unified into the fixing unit.

In the above-mentioned image forming apparatus, the fixing station may further include a pressure applying member configured to generate the pressure to be applied to the fixing roller and the fixing belt to push the receiving roller.

In the above-mentioned image forming apparatus, the fixing station may further include a stopper configured to stop at a predetermined position the fixing roller and the fixing belt from both being moved towards the receiving roller by the pressure applying member.

In the above-mentioned image forming apparatus, the fixing station may further include a pressure release member configured to release the pressure.

In the above-mentioned image forming apparatus, the fixing station may further include a release agent coating member configured to contact a surface of the receiving roller to coat the receiving roller with a release agent and to move away from the receiving roller, wherein the release agent coating member is moved away from the receiving roller when the recording sheet carries an image on a surface thereof.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION

Figure 1:
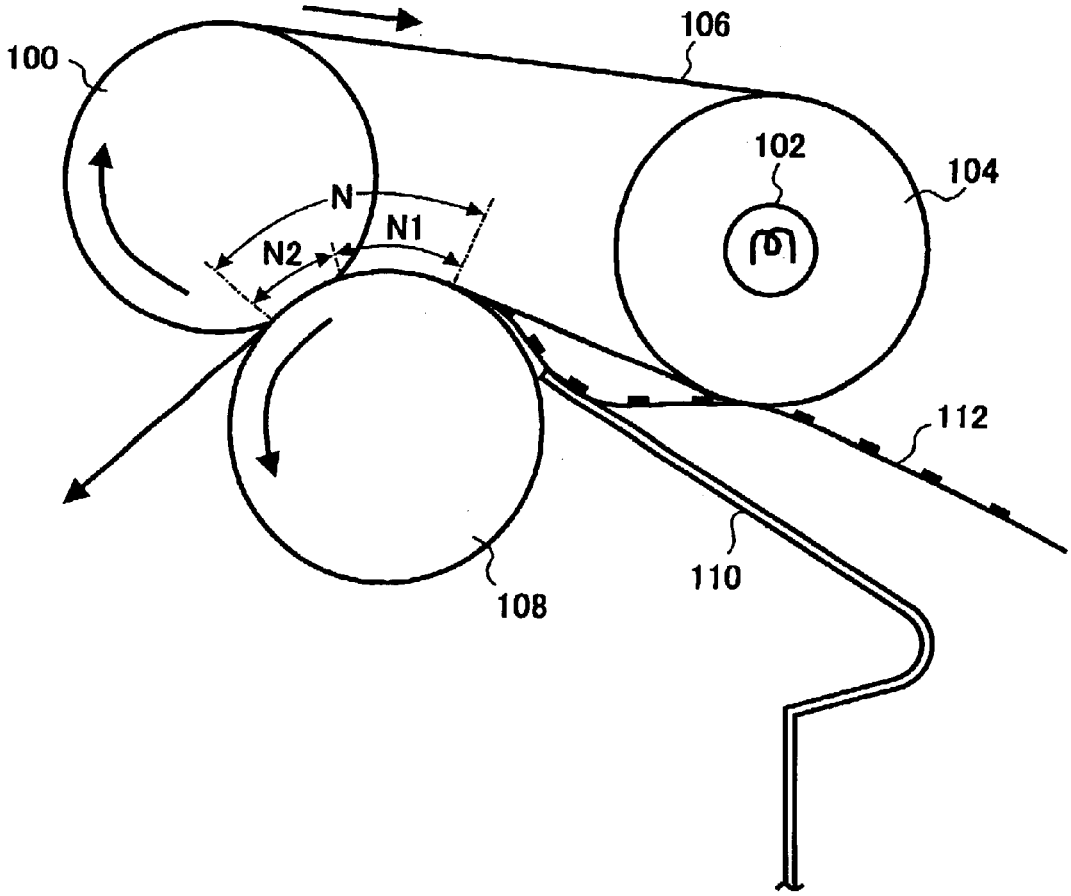
FIG. 1 PRIOR ART
FIG. 1 is a schematic representation of a prior art fixing station in which a recording sheet is caused to touch a fixing belt due to a slack of the recording sheet.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Figure 4:
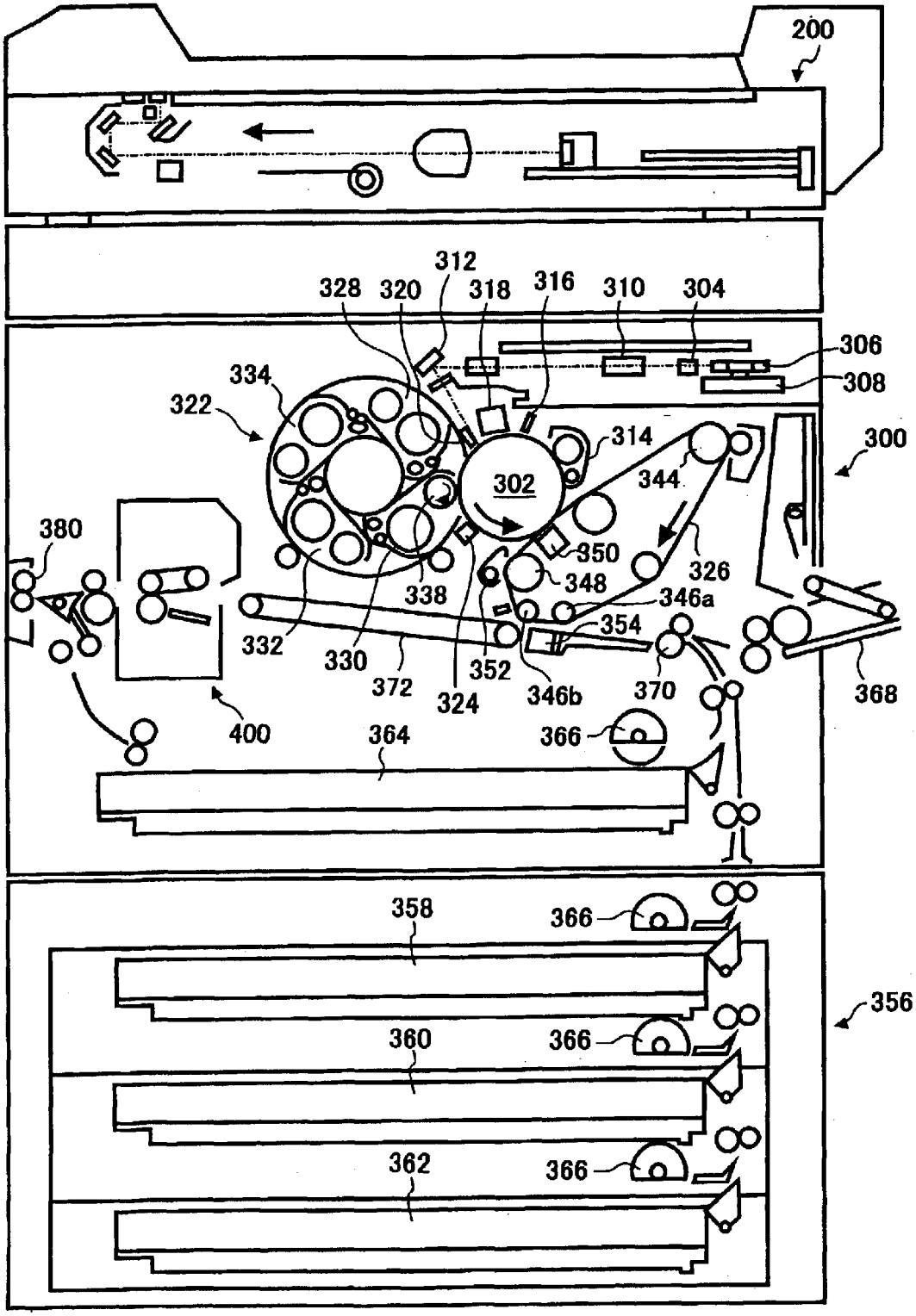
FIG. 4 is a schematic view of a color copying apparatus including a fixing station according to an embodiment of the present invention.

Referring now to the drawings, wherein like reference numerals designate identical or corresponding parts throughout the several views, particularly to FIG. 4, a color copying apparatus is explained as one example of an image forming apparatus according to an embodiment of the present invention. In the color copying apparatus of FIG. 4, an optical writing unit 300 receives color image data of an original image from a color scanner 200, converts the data into light signals, and performs "writing" on a photoconductor 302 with the light signals. The optical writing unit 300 thus forms an electrostatic latent image on the photoconductor 302 in accordance with the original image. The optical writing unit 300 includes a laser diode 304, a polygon mirror 306, a polygon motor 308, an f/θ lens 310, and a reflection mirror 312. The photoconductor 302 is rotated counterclockwise as indicated by an arrow and is surrounded by a photoconductor cleaning unit 314, a discharging lamp 316, a voltage sensor 320, a revolving development station 322, a developing density pattern detector 324, an intermediate transfer belt 326, and so on. The revolving development station 322 is revolved so that one of development units included therein is selected to face the photoconductor 302.

The revolving development unit 322 includes a black development unit 328, a cyan development unit 330, a magenta development unit 332, and a yellow development unit 334, and a revolving mechanism (not shown). For a purpose of visualizing the electrostatic latent image, each development unit includes a development sleeve (not shown), a development paddle (not shown), and so forth. The development sleeve is configured to be rotated while the top of the toner magnetically raised on the surface of the development sleeve contacts the photoconductor 302. The development paddle is configured to be rotated to input and mix developer.

During a standby condition, the revolving development station 322 is situated at a black development position and, after a copying operation is started, the color scanner 200 starts reading data of a black image in synchronism with a predetermined event. Then, the "writing" with the laser light in accordance with the image data is started to form an electrostatic latent image (a black latent image).

In order to develop the black latent image from its leading edge, the development sleeve is started to be rotated so as to make the black toner available before the leading edge of the black latent image reaches a black development position of the black development unit 328. The black latent image is thus developed with the black toner from its leading edge.

Upon a time when the trailing edge of the black latent image passes by the above-mentioned black development position, the revolving development station 322 is revolved from the black development position to a development position of the next color. This revolution is completed before the leading edge of the next image data reaches the development position of the next color.

When the image forming cycle is started, a driving motor (not shown) is energized to drive the photoconductor 302 counterclockwise and the intermediate transfer belt 326 clockwise. In synchronism with the rotation of the intermediate transfer belt 326, black, cyan, magenta, and yellow toner images are in turn formed and are overlaid in this order on the intermediate transfer belt 326. As a result, a single intermediate transfer image is formed on the intermediate transfer belt 236.

The intermediate transfer belt 326 is held under a tension by a driving roller 344, transfer rollers 346*a* and 346*b*, a belt cleaning roller 348, and a plurality of idle rollers. The driving roller 344 is controlled to be driven by a driving motor (not shown).

The black, cyan, magenta, and yellow toner images in turn formed on the photoconductor 302 are sequentially and accurately transferred to the surface of the intermediate transfer belt 326, thereby forming a single intermediate transfer image including the four color toner images overlaid on each other. This single intermediate transfer image is then transferred onto a recording sheet by a transfer corona discharger 354.

Each of recording sheet cassettes 358, 360, and 362 included in a sheet supply bank 356 contains recording sheets different in size from those contained in an internal sheet cassette 364. One of these cassettes is selected and a recording sheet is picked up from the selected sheet cassette and is fed by a feed roller 366 to a pair of registration rollers 370 which will further feed the recording sheet. In FIG. 4, reference numeral 368 denotes a manual-insertion sheet tray for an OHP (overhead projector) sheet, a thick sheet, etc.

In synchronism with a start of the image forming, a recording sheet fed from one of the sheet cassettes in the manner described above is held on standby at a nip of the registration rollers 370. When the leading edge of the toner image held on the intermediate transfer belt 326 is conveyed to pass by the corona discharger 354, the registration rollers 370 are driven such that the leading edge of the recording sheet meets the leading edge of the toner image. Thus, a registration of the recording sheet relative to the toner image is achieved.

In this way, the recording sheet is moved in contact and together with the intermediate transfer belt 326 to pass over the corona discharger 354 charged with a positive voltage. At this time, the recording sheet is charged with the positive charge by a current generated by the corona discharge, with which the toner image is transferred onto the recording sheet. The recording sheet is further moved to pass by a discharging brush which is located at a position above left relative to the corona discharge 354 in FIG. 4 although it is not shown and is in turn discharged by the discharging brush. This discharge causes the recording sheet to be separated from the intermediate transfer belt 326 and, subsequently, to be transferred onto a sheet transfer belt 372.

The recording sheet having the four-color-overlaid toner image transferred from the intermediate transfer belt 326 is conveyed by the sheet transfer belt 372 to a fixing station 400 which fixes the toner image onto the recording sheet with heat and pressure. After the fixing, the recording sheet is ejected to an outside tray (not shown) by a pair of ejection rollers 380. Thus, a full-color copy is produced.

Figure 5:
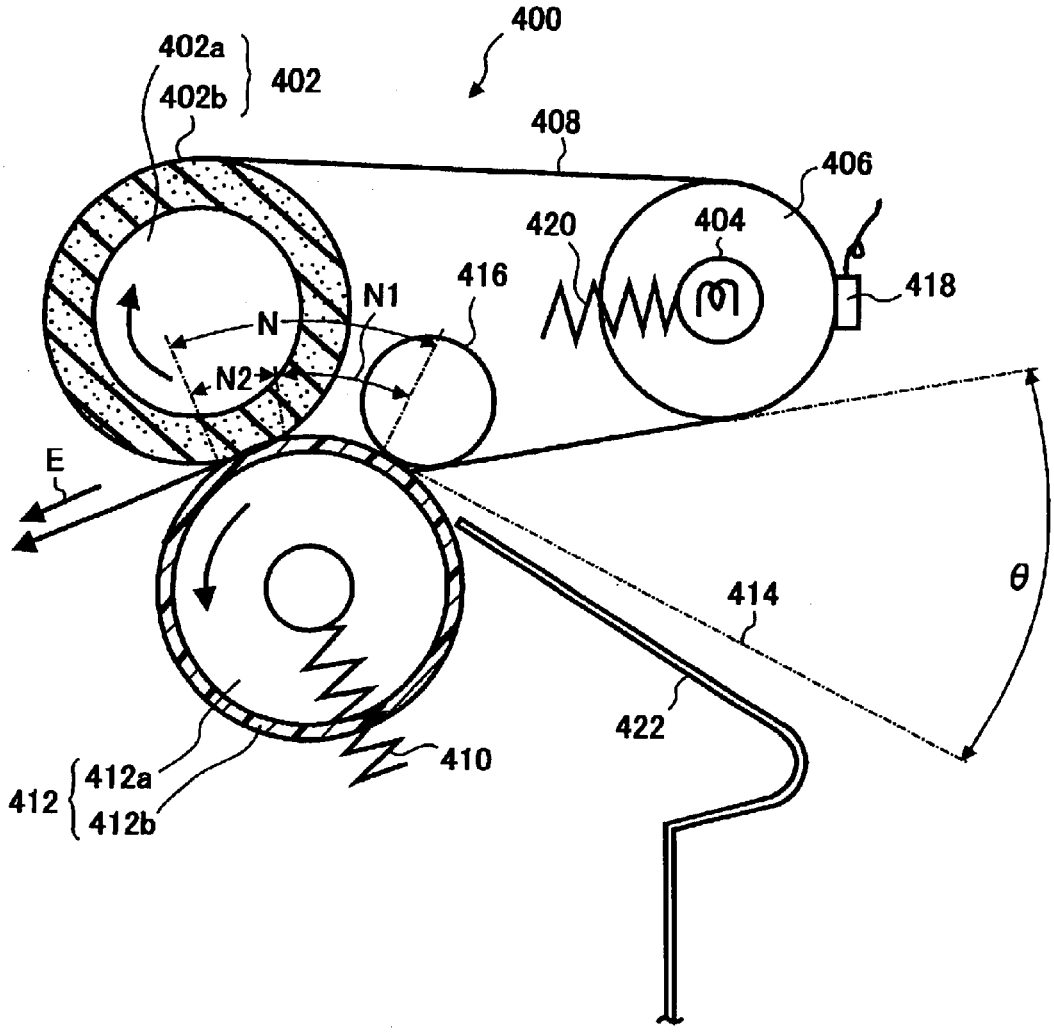
FIG. 5 is a schematic cross-sectional view of the fixing station of FIG. 4.

Referring to FIG. 5, the belt-type fixing station 400 is explained in detail. As shown in FIG. 5, the fixing station 400 includes a fixing roller 402, a heat roller 406 internally including a halogen heater 404 serving as a heating source for the fixing, and a seamless fixing belt 408 held in tension between the fixing roller 402 and the heat roller 406. The fixing station 400 further includes a pressure roller 412, a supporting roller 416, a thermistor 418, pressure springs 410 and 420, and a guide member 422. An angle shown as θ in FIG. 5 is explained later.

The pressure roller 412 is arranged to face the fixing roller 402 via the fixing belt 408 and is pressed by the pressure spring 410 so as to press the fixing roller 402. The supporting roller 416 is arranged to be located inside the fixing belt 408 in contact therewith at the side of the fixing roller 408 from which a recording sheet 414 is conveyed thereto so as to wind the fixing belt 408 around the pressure roller 412 and to change the direction of a path of the fixing belt 408. The thermistor 418 is configured to detect a temperature of the fixing belt 408. The pressure spring 420 is configured to press the heat roller 406 in the direction approximately opposite to a direction E in which the recording sheet 414 is ejected. The guide member 422 is configured to guide the recording sheet 414 to a nip area formed by the fixing belt 408 and the pressure roller 412.

As shown in FIG. 5, a first nip portion for serving as a first fixing process area N1 is formed between the fixing belt 408 and the pressure roller 412 with the winding force of the supporting roller 416 and, at a position downstream of the first fixing process area N1, a second nip portion for serving as a second fixing process area N2 is formed between the fixing roller 402 and the pressure roller 412 via the fixing belt 408. The first and second fixing process areas N1 and N2 together constitute an entire nip portion for serving as an entire fixing process area N.

The fixing belt 408 includes a seamless thin belt made of nickel, heat-resistant resin such as polyimide, carbon steel, stainless steel, or the like, and is coated with a heat-resistant release layer made of fluoride resin, silicone rubber, or the like on the outside surface thereof. Here, the seamless belt is achieved with galvanoplastics or it is substituted by a belt having a seam which is manufactured with an accurate butt-joining technique such as a welding using an extremely-thin plate made of stainless steel or ferrous metals. The fixing belt 408 is heated by the halogen heater 404 via the heat roller 406 and is controlled to have a predetermined temperature by a control mechanism (not show) of the color copying apparatus based on a detection of the thermistor 418.

The fixing roller 402 includes a core metal 402*a* at its center and a heat-insulating elastic member 402*b* covering the surface of the core metal 402*a* so that a sufficiently-wide nip is formed on the surface of the fixing roller 402. The heat-insulating elastic member 402*b* may be made of soft heat-insulating materials such as a foam silicone-rubber, and has a sufficient thickness. In this example shown in FIG. 5, the heat-insulating elastic member 402*b* has a thickness in an approximate range of from 15% to 20% of the diameter of the fixing roller 402. The fixing roller 402 is driven to be rotated in a direction as indicated by an arrow, by a driving source (not shown), following which the pressure roller 412 is rotated in a direction indicated by an arrow. As an alternative, the pressure roller 412 may be driven to be rotated by the driving source so as to subsequently rotate the fixing roller 402.

The pressure roller 412 includes a core metal 412*a* and a heat-resistant release layer 412*b* covering the surface of the core metal 412*a*. The core metal 412*a* is made of aluminum, stainless steel, stainless carbon, or the like, and the heat-resistant release layer 412*b* is made of fluoride resin, silicone rubber, or the like.

In this example shown in FIG. 5, the fixing process area N is formed in a circular arc opening downwards by increasing the hardness of the pressure roller 412 so that the recording sheet 414 can readily separated from the fixing belt 408. The heat roller 406 is, for a quick start-up, configured to be of relatively small heat capacity by being made of a thin metal pipe having a relatively small diameter, the material of which can be of aluminum, iron, copper, carbon steel, stainless steel, or the like.

Figure 6:
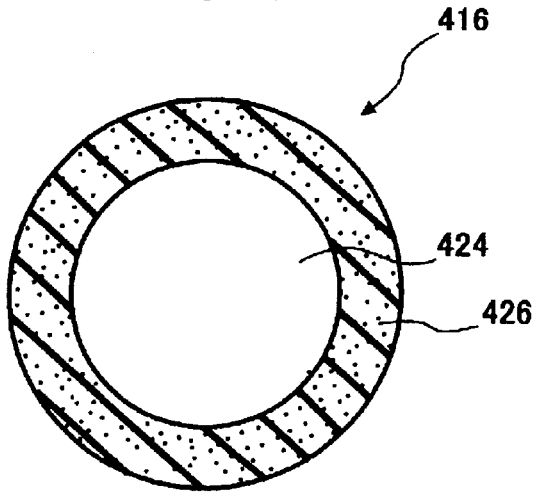
FIG. 6 is a schematic cross-sectional view of a supporting roller included in the fixing station of FIG. 5.

As illustrated in FIG. 6, the supporting roller 416 includes a core metal 424 and a surface layer 426 for serving as a heat insulating member, covering the surface of the core metal 424. The surface layer 426 is made of foam silicone rubber. Other materials such as rubber, ceramic, felt, or the like may also be used for the surface layer 426. It is of course possible that the supporting roller 416 is entirely made of a heat insulating material.

In the first fixing process area N1, a contact pressure of the fixing belt 408 relative to the pressure roller 412 serving as a contact pressure for N1 is set to a relatively low level. This fixing pressure is set by adjusting a tension of the fixing belt 408 with the pressure spring 420. In the second fixing process area N2, the pressure roller 412 generates a fixing pressure for N2 by contacting the fixing belt 408 against the fixing roller 402 so that the fixing is carried out at a desired level. This fixing pressure is set with the pressure spring 410.

The fixing process of the example shown in FIG. 5 is performed by an action in that the recording sheet 414 is moved to pass through the fixing process areas N1 and N2, successively. In the fixing process area N1 having the comparatively lower fixing pressure, the recording sheet 414 is smoothly conveyed without making wrinkles to the fixing process area N2, while receiving a pre-heat. Subsequently, in the fixing process area N2, the recording sheet 414 is subjected to a predetermined temperature and a predetermined fixing pressure so that the fixing is completed.

Since a heat capacity of the fixing belt 408 is relatively low, the fixing belt 408 rapidly decreases its temperature at an area around an exit of the fixing process area N2. This causes an advantageous cooling effect by which the fixing belt 408 is protected from an offset problem in which the fixing belt 408 is deposited by the toner.

Figure 7:
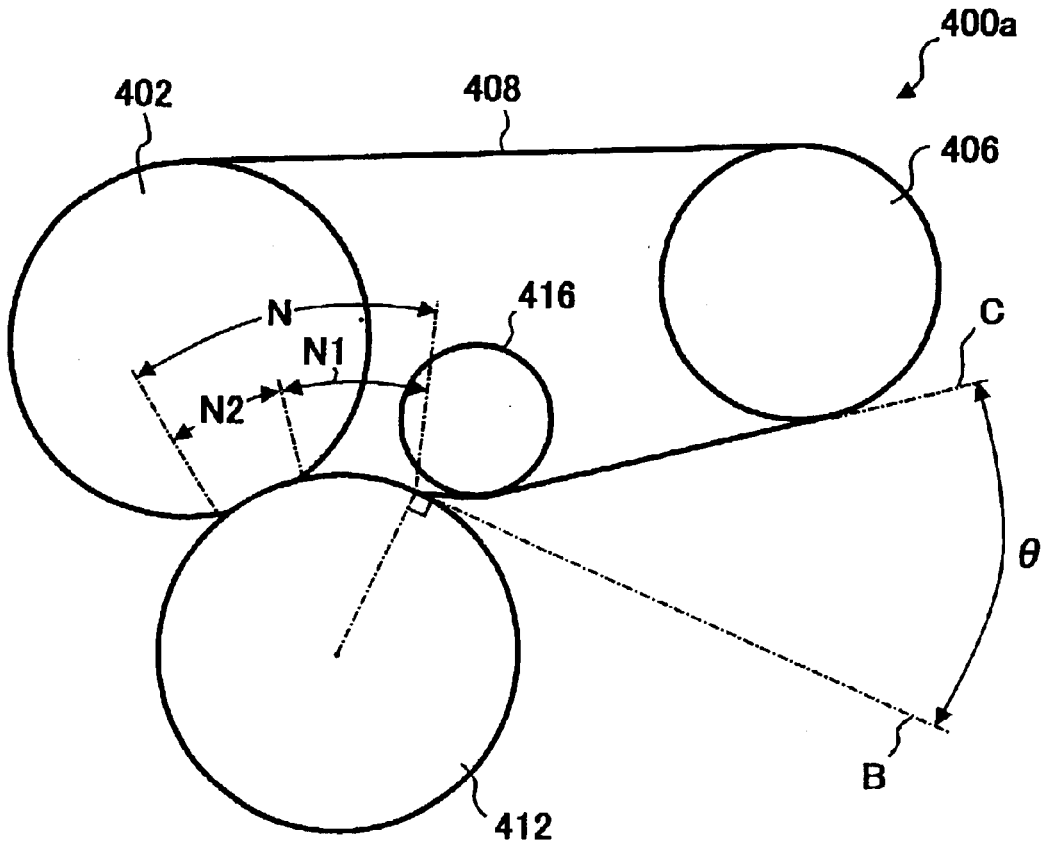
FIG. 7 is an illustration of the rollers of the fixing station of FIG. 5 for explaining a fixing process area and a belt angle.

In the present example being explained, as illustrated in FIG. 7, the pressure roller 412, the supporting roller 416, and the heat roller 406 are arranged such that an angle (referred to as a belt angle) θ is made greater than 0 degrees, more specifically, equal to or greater than 10 degrees, wherein the angle θ is formed by a tangent line B of the pressure roller 412 at an entrance area of the fixing process area N1 with a tangent line C of the fixing belt 408 at an area between the supporting roller 416 and the heat roller 406. The reason for this arrangement is described below.

Figure 8:
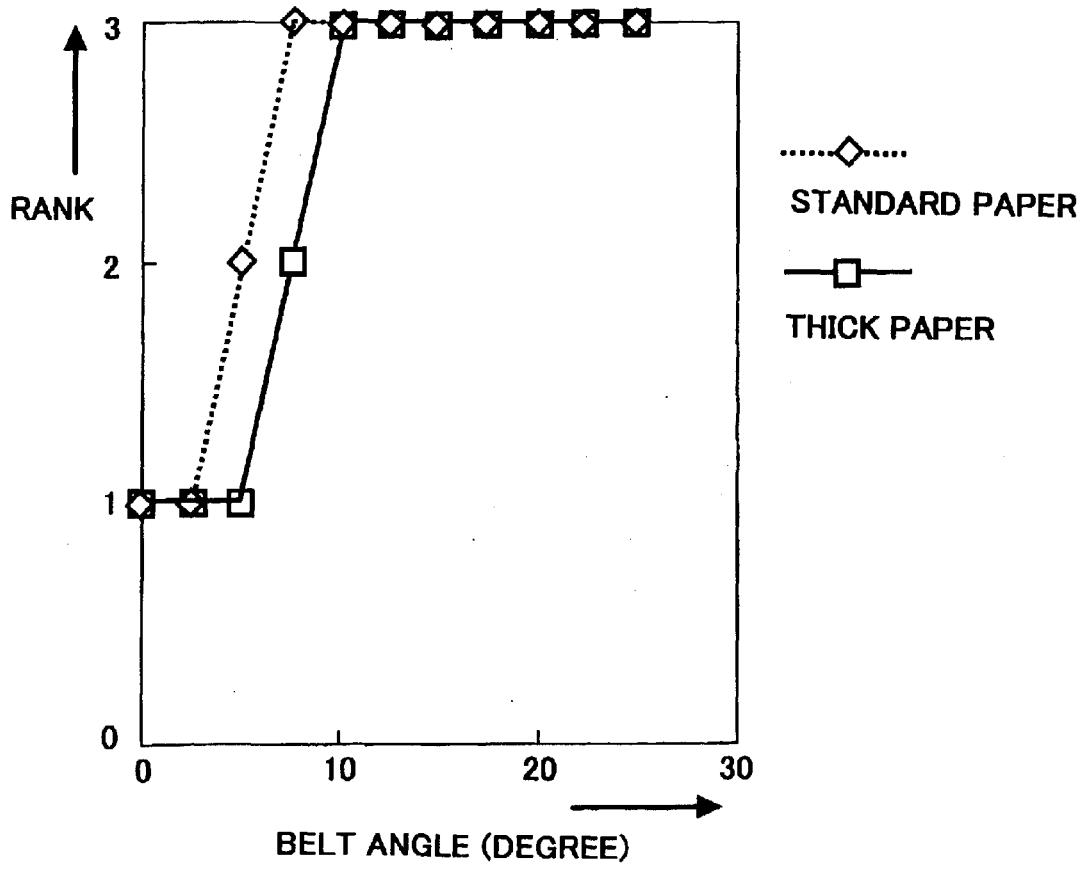
FIG. 8 is a graph demonstrating experimental results of the fixing with variations of the belt angle value.

FIG. 8 is a graph for showing results of experiments for measuring the severity of rubbing the toner image depending upon the belt angle θ. As shown in FIG. 8, a rank of rubbing severity stays at 1, which is bad, with the belt angle θ between 0 degrees and 5 degrees. With the belt angle θ between 5 degrees and 10 degrees, the rank is increased, which is good. However, in the case of using a thick paper, rubbing of the toner image still occurs because of the rigidity of the thick paper which causes a slight vibration on the sheet at a trailing edge when the sheet is released from the fixing roller.

In view of the above experimental results, the belt angle θ in the example according to the present invention is preferably adjusted to a value greater than 10 degrees, regardless of how thick the recording sheet 414 is.

As described above, the heat capacity of the fixing belt is far smaller than that of a fixing roller used in a roller type fixing mechanism. Therefore, in a configuration in which the heat roller 406 is located upstream in the sheet flow from the fixing process area N where the fixing belt 408 contacts the recording sheet 414, it is desirable to protect the fixing belt 408 from loosing heat until it reaches the fixing process area, so that a heat efficiency of the fixing station is improved. From this view point, the above-described configuration of the fixing station has an advantage because the recording sheet 414 is prevented from contacting the fixing belt 408 before the leading edge of the recording sheet 414 reaches an entrance of the fixing process area N1.

In addition, in the fixing station 400, the supporting roller 416 is configured to include the surface layer 426 for serving as a heat-insulating member and, therefore, an amount of heat moving from the fixing belt 408 to the supporting roller 416 is very small. This results in a relatively great improvement of the fixing efficiency of the fixing station.

Figure 9:
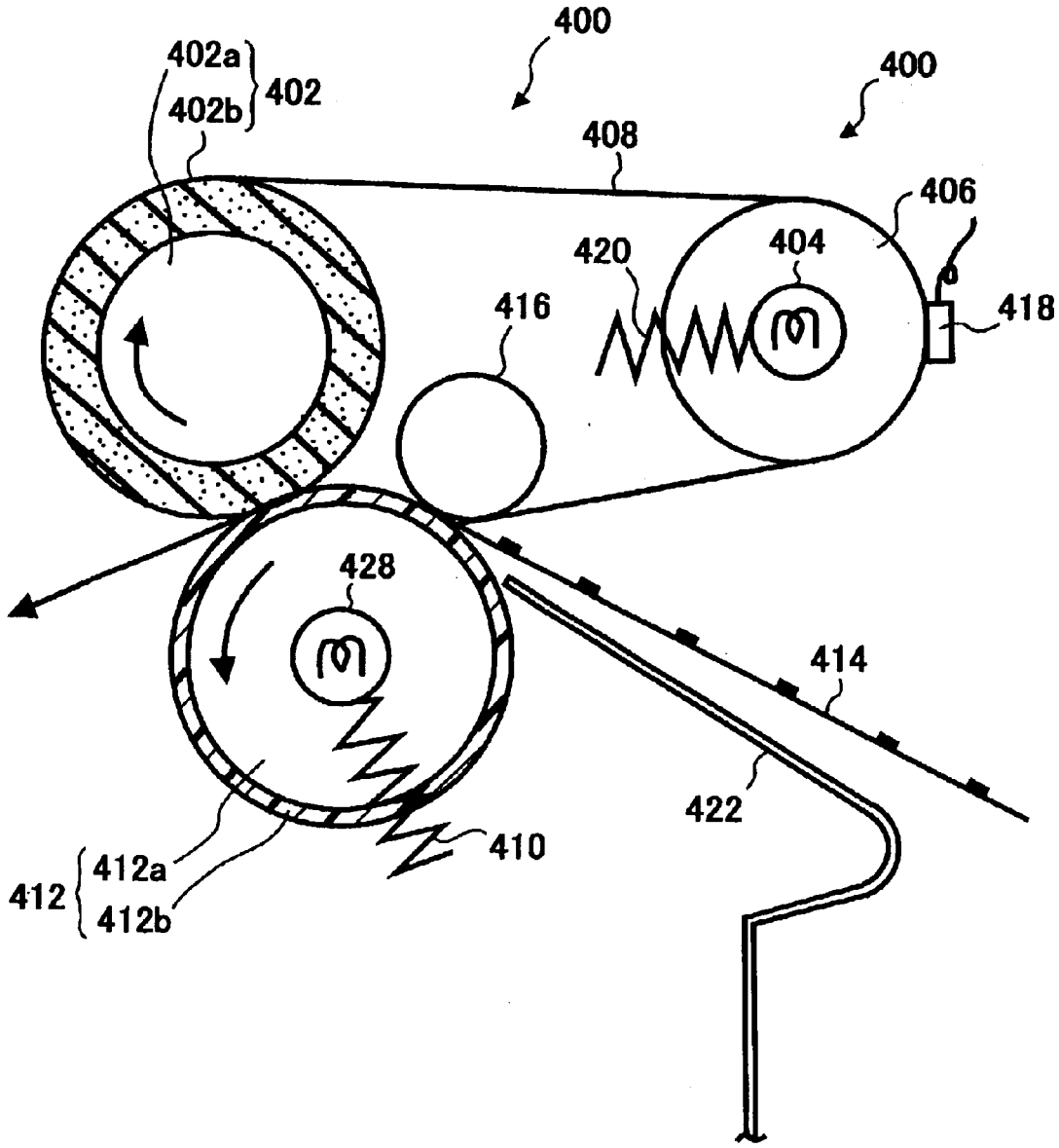
FIG. 9 is a cross-sectional view of a variation model based on the fixing station of FIG. 5.

Referring to FIG. 9, a variation of the fixing station 400 is explained. FIG. 9 shows a fixing station 400*a* which is similar to the fixing station 400 of FIG. 5, except for a halogen heater 428. That is, the fixing station 400 of FIG. 5 has a single heat source for the fixing process, which is the halogen heater 404 deposited inside the heat roller 406, however, the fixing station 400*a* includes an additional heat source for the fixing process, which is the halogen heater 428 arranged inside the pressure roller 412.

In this case, the halogen heater 428 has a function for preventing the heat movement from the fixing belt 408 to the pressure roller 412. The halogen heater 428 may merely have a function for making a predetermined fixing temperature together with the halogen heater 404.

Figure 10:
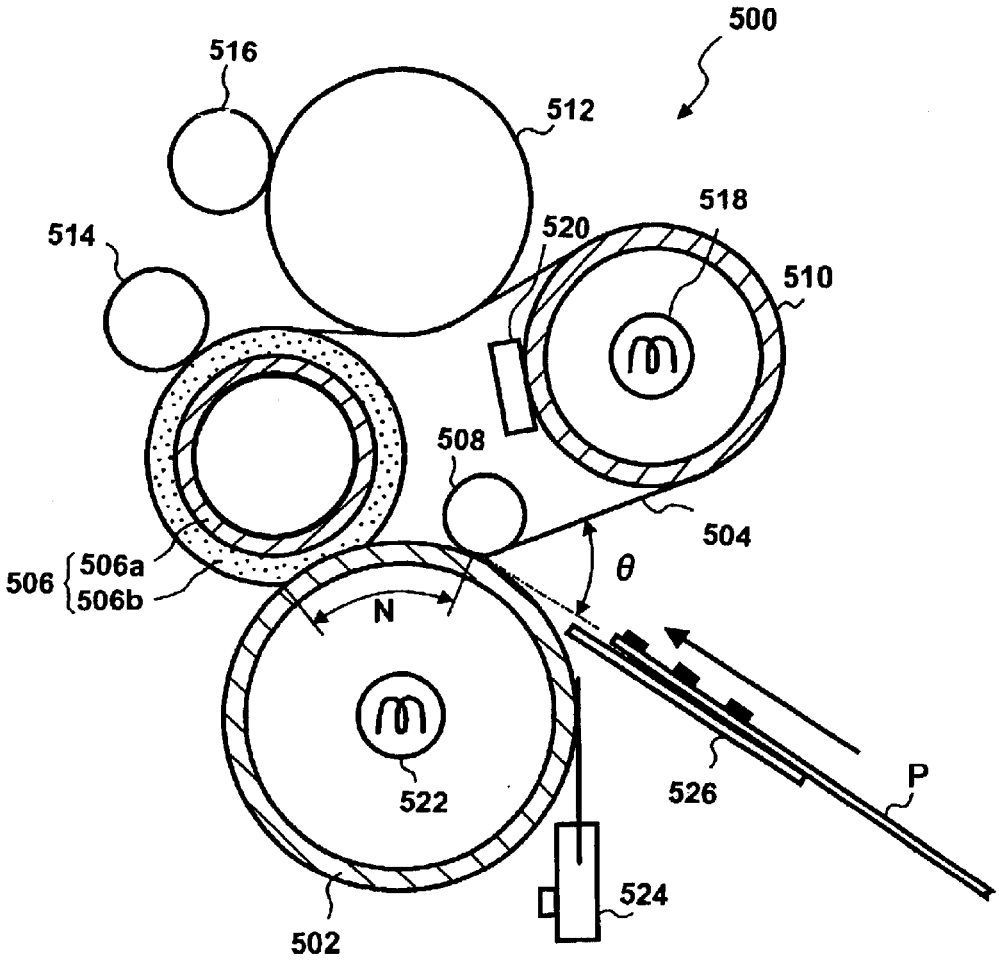
FIG. 10 is a schematic cross-sectional view of another fixing station according to an embodiment of the present invention.

Next, another example of the belt-type fixing station is explained with reference to FIG. 10. In FIG. 10, a fixing station 500 is illustrated. The fixing station 500 of FIG. 10 includes a receiving roller 502, a fixing belt 504, a fixing roller 506, a supporting roller 508, a heat roller 510, an oil-coating roller 512, a belt cleaning roller 514, and a cleaning roller 516. The receiving roller 502 is fixed at a predetermined position in the fixing station 500, serving as a driving roller, and is configured to receive an incoming recording sheet P. The fixing roller 506, the supporting roller 508, and the heat roller 510 support the fixing belt 504 from inside the fixing belt 504. The oil-coating roller 512 serves to coat a release agent to the fixing belt 504. The belt cleaning roller 514 cleans the surface of the fixing belt 504. The cleaning roller 516 cleans the oil-coating roller 512.

The heat roller 510 is provided with a halogen heater 518 inside the heat roller 510 to serve as a heat source for heating the fixing belt 504. On the surface of the heat roller 510, a thermistor 520 is provided in contact therewith to detect a fixing temperature generated by the heat roller 510. A feedback control of the fixing temperature is carried out by a control mechanism (not shown) based on a detection value from the thermistor 520.

In order to increase a rising speed of the fixing station 500, the receiving roller 502 is inside provided with a halogen heater 522, and the fixing temperature of the receiving roller 502 is also feedback-controlled by a control mechanism (not shown) based on a detection value of surface temperature of the receiving roller 502 detected by a thermistor 524 arranged in contact with the surface of the receiving roller 502.

The fixing belt 504 includes a nickel-electroformed or polyimide base member having a thickness of from 40 $\mu$m to 90 $\mu$m, on which a silicone rubber layer having a thickness of approximately 200 $\mu$m is coated.

Figure 11:
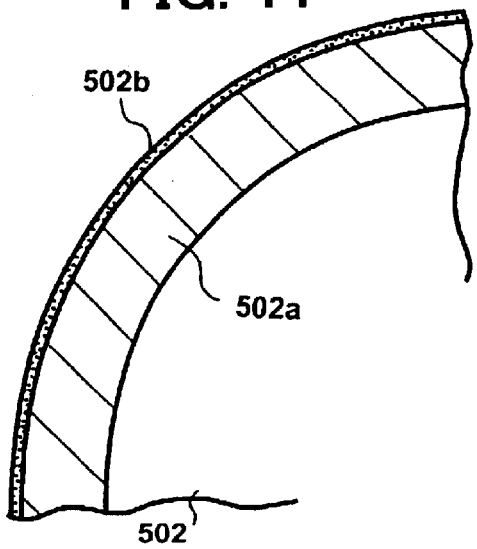

The fixing roller 506 serving as a following roller includes a metal core 506*a* made of aluminum, iron, or the like and a thick elastic layer 506*b*, made of silicone foam and which covers the surface of the metal core 506*a*. The receiving roller 502 has a greater structural stiffness, preventing from deformations, in comparison to the fixing roller 506. That is, as illustrated in FIG. 11, the receiving roller 502 includes an iron-made hard tubular metal core 502*a* of a 1-mm thick and a high-release-effect elastic layer 502*b* having a thickness of 200 $\mu$m or less which covers on the surface of the metal core 502*a*. In the fixing station 500, the thickness of the layer 502*b* is configured to be 70 $\mu$m and is made of a high-release silicone rubber.

Figure 12:
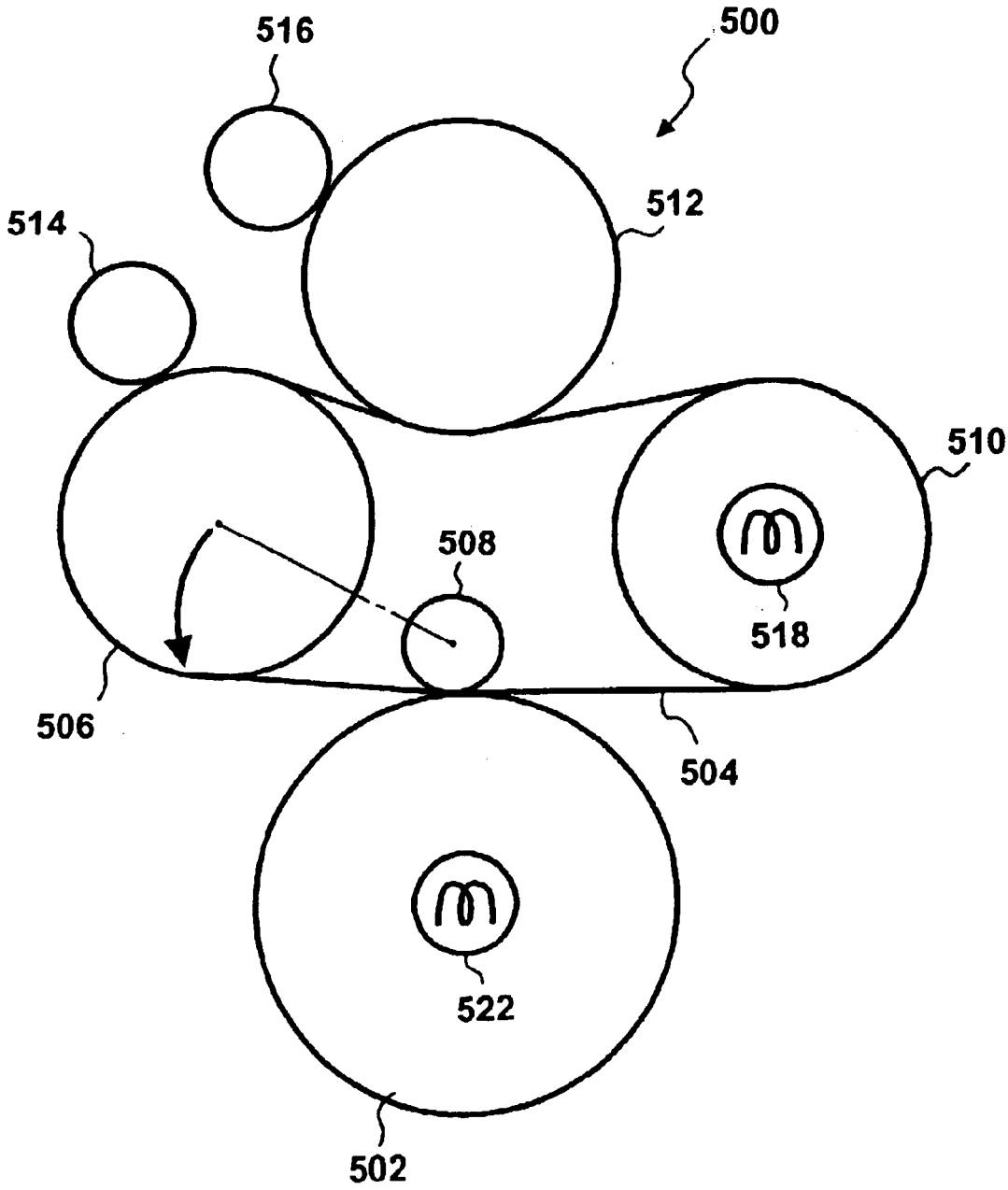
FIG. 12 is a schematic cross-sectional view of a part of a receiving roller of the fixing station of FIG. 10.

The fixing belt 504, the fixing roller 506, the supporting roller 508, and the heat roller 510 are major components for constituting a fixing belt unit. The oil-coating roller 512, the belt cleaning roller 514, and the cleaning roller 516 are major components for forming an oil unit. The fixing belt unit and the oil unit are mechanically unified in one body. The supporting roller 508 has a rotation axis fixed at a predetermined location in the fixing belt unit as the receiving roller 502 is so. As illustrated in FIG. 12, the fixing belt unit and the oil unit unified in one unit are moved under pressure to pivot about the rotation axis of the supporting roller 508. With this movement under pressure, a nip (i.e., the fixing process area N) is formed between the fixing belt 504 and the receiving roller 502 which are in contact, as illustrated in FIG. 10. Since the oil unit and the fixing belt unit are moved as one unit, the oil-coating roller 512 needs no adjustment of position relative to the fixing belt 504 after an application of pressure. This facilitates an assembling process of the fixing station 500.

The fixing process area N is composed of two nip portions; a first portion is formed between the receiving roller 502 and the fixing roller 506 via the fixing belt 504 by an application of pressure of the receiving roller 502 to the fixing roller 506 and the fixing belt 504, and a second portion is formed between the receiving roller 502 and the fixing belt 504 which is pulled downwards to cover part of the surface of the receiving roller 502 in contact under pressure by the supporting roller 508 located upstream in the flow of the incoming recording sheet P relative to the fixing roller 506. In a configuration in which the supporting roller 508 is excluded, the fixing process area N is composed only of the former one.

As illustrated in FIG. 10, the incoming recording sheet P carrying an image on the surface thereof is guided by a guide plate 526 and is subsequently guided by the receiving roller 502 to enter into the fixing process area N such that the image surface of the recording sheet P is held upwards and in contact with the fixing belt 504 at the side of the fixing roller 506. Thereby, the fixing process is carried out without degrading the quality, particularly a shining property, etc., of the image.

Figure 13:
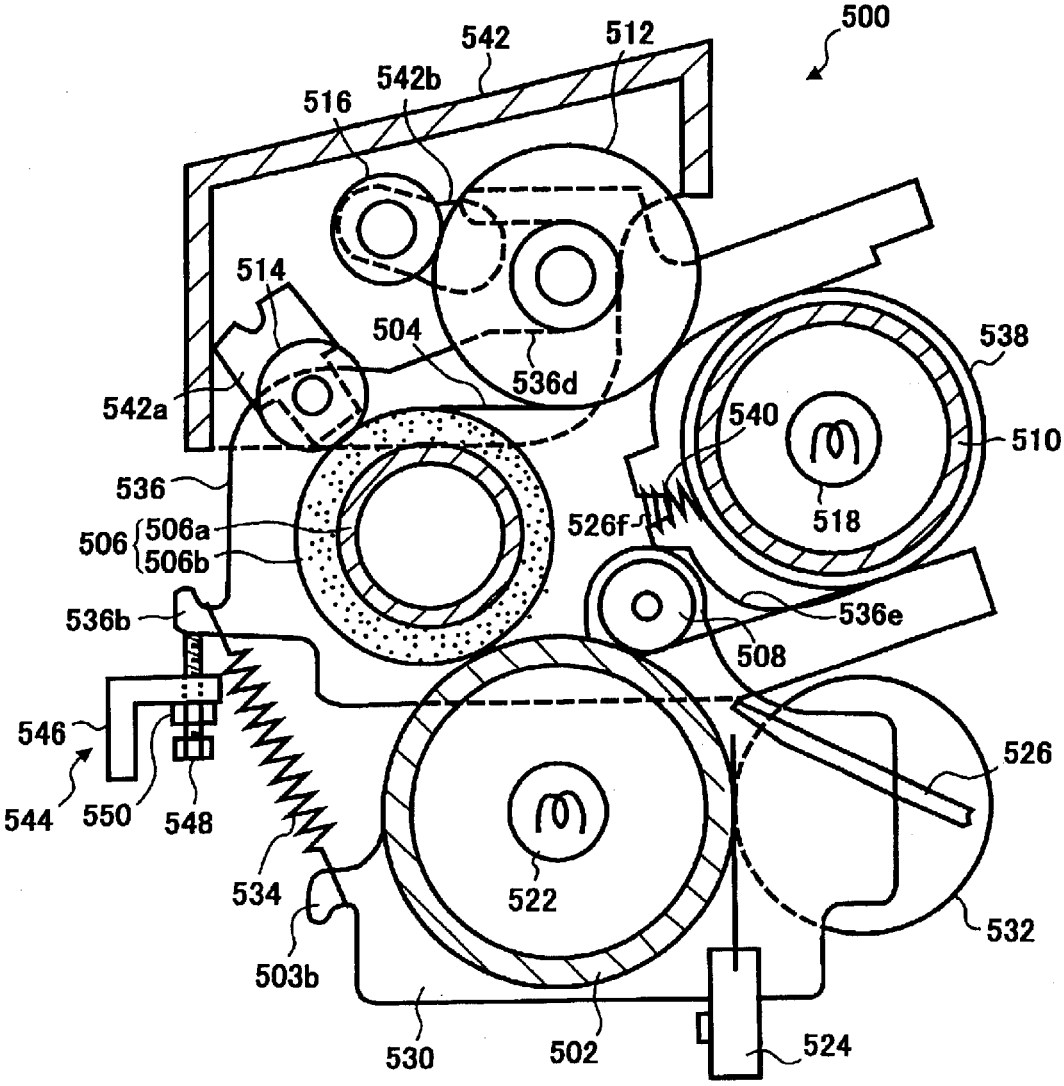
FIG. 13 is a schematic cross-sectional view of the fixing station of FIG. 10.
Figure 14:
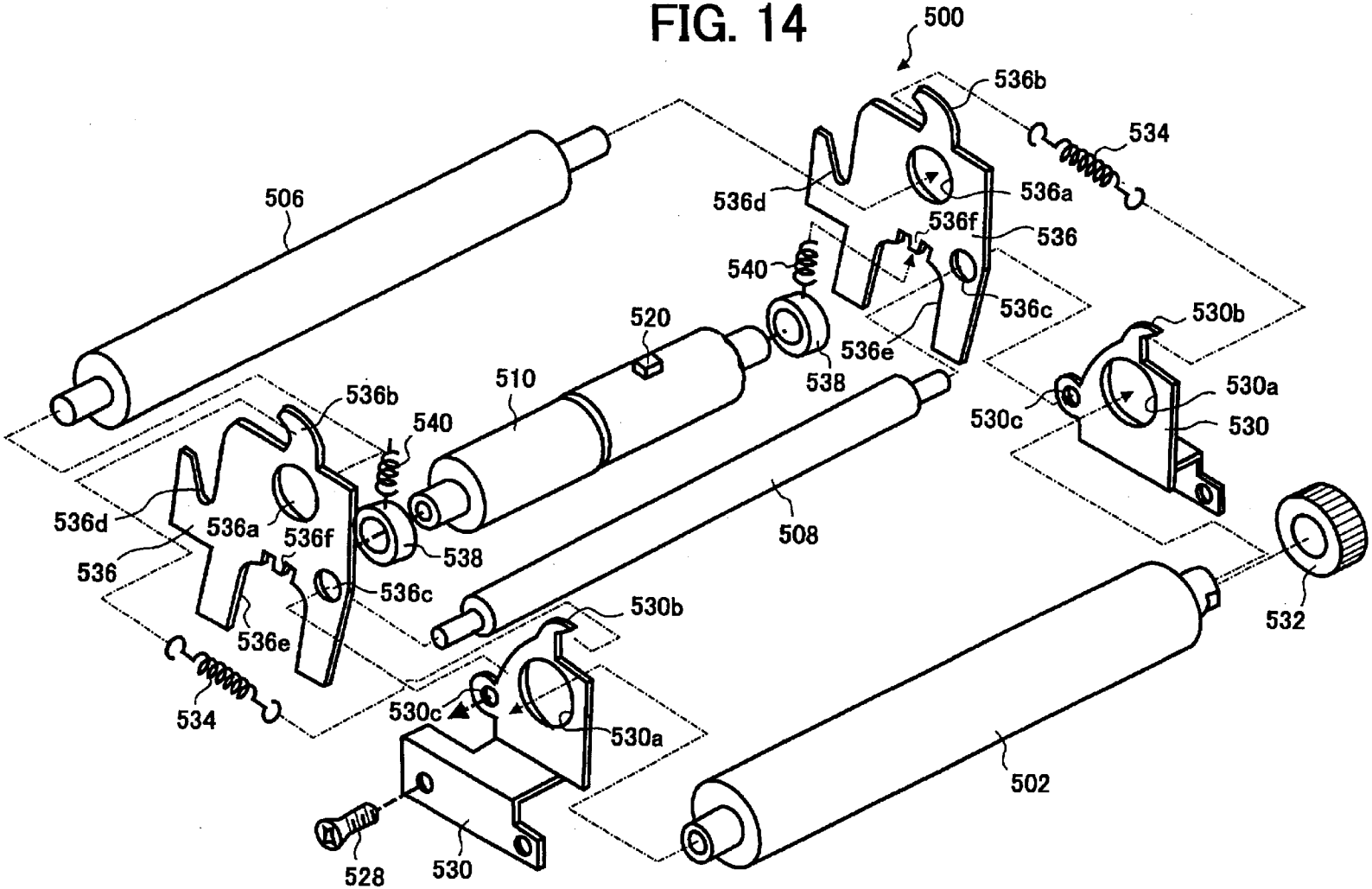
FIG. 14 is a schematically-exploded perspective view of a major portion of the fixing station of FIG. 10.
Figure 15:
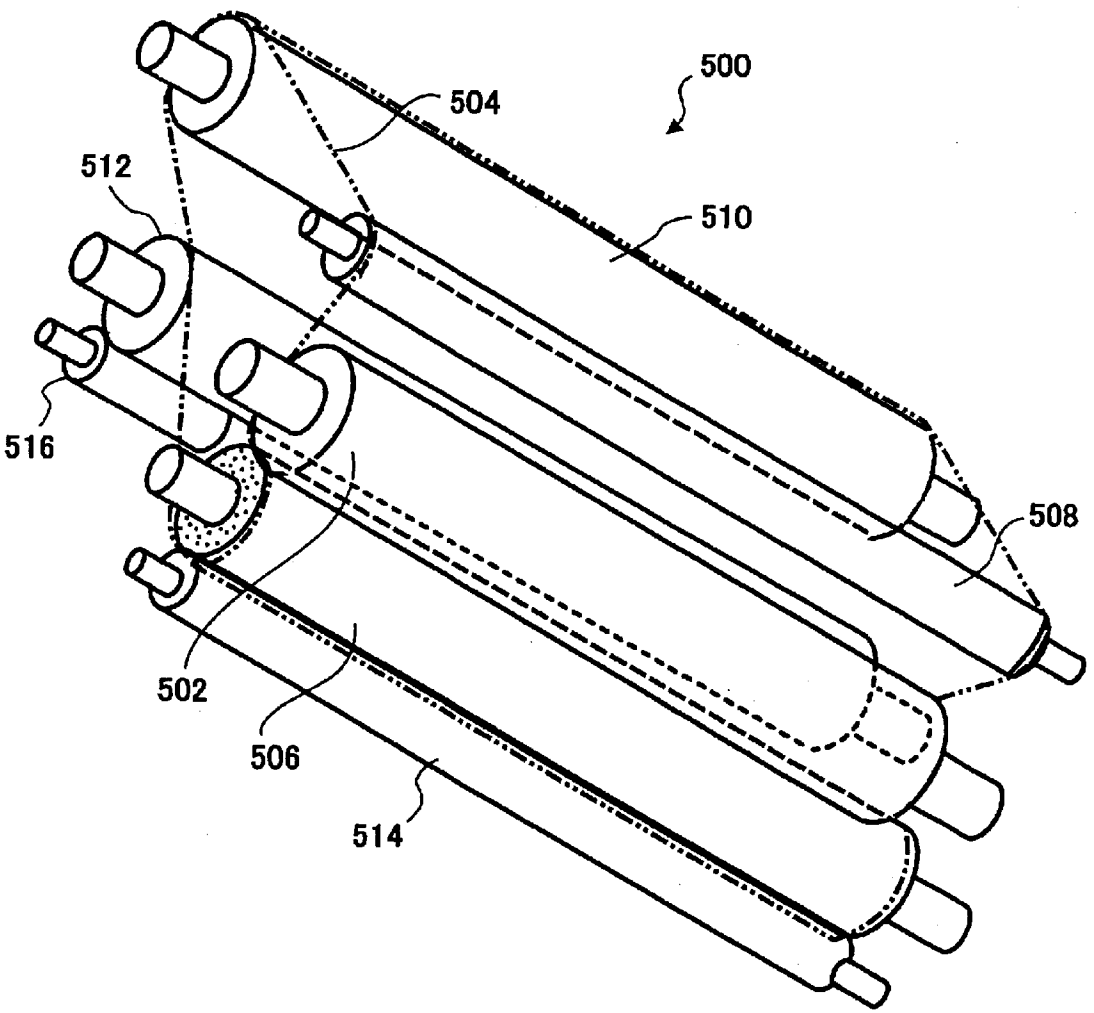
FIG. 15 is a schematic perspective view for explaining relationships between a fixing belt and various rollers of the fixing station of FIG. 10.

Referring to FIGS. 13 to 15, mechanical operations of the fixing station 500 are explained in detail. FIG. 13 is a schematic cross-sectional view of the fixing station 500. FIG. 14 is a schematically-exploded perspective view of a major portion of the fixing station 500, and FIG. 15 is a schematic perspective view of the fixing station 500 for explaining relationships between the fixing belt 504 and various rollers of the fixing station 500.

As illustrated in FIG. 14, the receiving roller 502 is held by a pair of brackets 530, each secured to a side plate (not shown) of the fixing station 500 by screws 528, via holding holes 530*a*. On one end of the receiving roller 502, a driving gear 532 is secured, to which a driving force from a driving source (not shown) is input. Each bracket 530 includes a hook 530*b* for hooking one end of a pressure spring 534 for providing a tension to the bracket 530 and a holding hole 530*c* for holding the supporting roller 508.

The fixing roller 506 is held by a pair of brackets 536 via holding holes 536*a*. Each bracket 536 includes a hook 536*b* for hooking the other end of the pressure spring 534 and a holding hole 536*c* for holding the supporting roller 508. The bracket 536 further includes a notch 536*d* for supporting the oil-coating roller 512 and another notch 536*e* for supporting the heat roller 510.

The bracket 530 is placed on the bracket 536 such that the holding hole 530*c* is overlaid on the holding hole 536*c*, and one end of the supporting roller 508 is entered into the holding holes 530*c* and 536*c*. Thereby, the fixing belt unit is set movable relative to the bracket 530 secured to the fixing station 500, pivoting about the rotation axis of the supporting roller 508.

The heat roller 510 is provided with a collar 538 on each end, which is guided by both sides of the notch 536*e* so that the heat roller 510 can be moved in accordance with the variations of the tension of the fixing belt 504 without causing a rolling movement. As illustrated in FIG. 14, a projection 536*f* is formed in the notch 536*e* and, between the projection 536*f* and the collar 538, a spring 540 is provided to give a tension to the fixing belt 504.

As illustrated in FIG. 13, the oil unit includes a bracket 542 for serving as a base plate, which includes a holding hole 542*a* for holding the belt cleaning roller 514, a holding hole 542*b* for holding the cleaning roller 516, and so on. The oil-coating roller 512 is held by the bracket 542 as well as by the holding hole 536*d* of each bracket 536, as described above. Thereby, the fixing belt unit and the oil unit are movable in one unit to pivot about the rotation axis of the supporting roller 508.

Near the hook 536*b* of the bracket 536 for hooking the pressure spring 534, a stopper 544 is provided for stopping the fixing roller 506, which is moved towards the receiving roller 502 by the pressure spring 534, at a predetermined position. The stopper 544 includes a bracket 546 secured to the side place (not shown) of the fixing station 500, a screw 548 which is engaged into a screw hole of the bracket 546 and of which tip makes contact with the hook 536*b*, and a fastening nut 550 for preventing the screw 548 from coming loose. By adjusting the screw 548, the position of the fixing roller 506 relative to the receiving roller 502, regardless of the strength of the pressure spring 534. That is, the fixing pressure and the nip width of the fixing process area N can be finely adjusted without the needs of changing the pressure spring 534. As an alternative, such stopper 544 may be removed from the fixing station 500.

Alternatively, the axis of the fixing roller 506 may be adjusted to move slightly towards the receiving roller 502 and an elastic deformation of the thick elastic layer 506*b* is used in place of the pressure spring 534 for applying a pressure to the fixing roller 506 relative to the receiving roller 502. The configuration of the pressure roller 534 and the stopper 544, however, have an advantage in that the pressure can easily and accurately be adjusted, thereby obtaining a most preferable fixing pressure.

Figure 3:
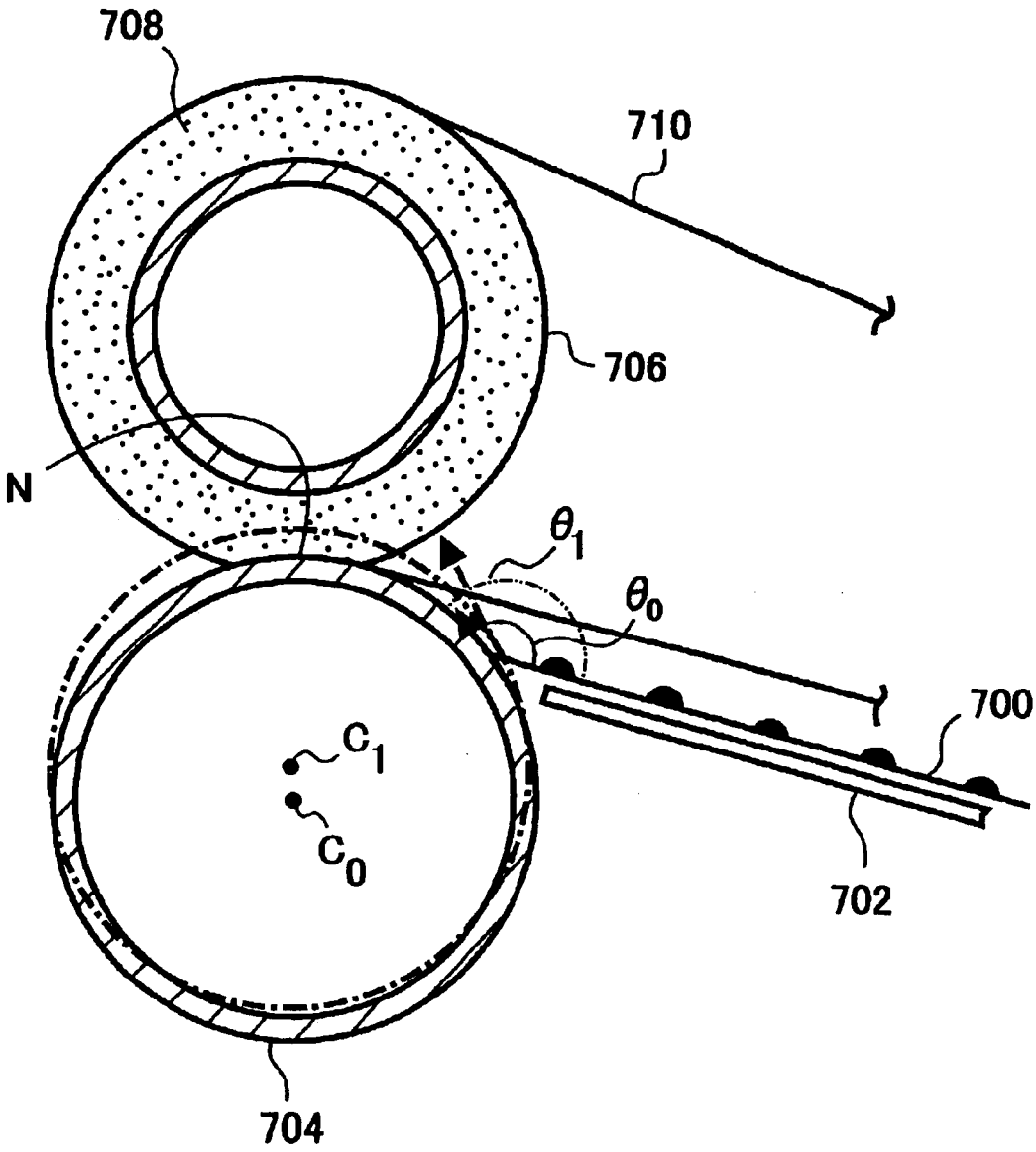
FIG. 3 PRIOR ART
FIG. 3 is a schematic representation of another prior art fixing station in which an angle for a recording sheet to approach varies due to wearing of a fixing roller over time.

As illustrated in FIG. 10, the incoming recording sheet P having an image thereon is guided by the guide 526 and is transferred to the fixing process area N. During the transfer, the toner on the recording sheet P is heated and is partly melted with a heat radiation from the fixing belt 504 heated by the heat roller 510, and the leading edge of the recording sheet P is guided by the surface of the receiving roller 502 to enter into the fixing process area N. Since the receiving roller 502 is firmly secured, an angle for the recording sheet P to approach the fixing process area N is stably maintained. Therefore, the problem such as a paper jam, described earlier with reference to FIG. 3, is not caused.

When the recording sheet P is entered into the first portion of the fixing process area N, the toner is heated, entirely melted, and pressed through the fixing process area N. Thus, the fixing of the toner is proceeding. Subsequently, in the second portion of the fixing process area N, the fixing is completed and, afterwards, the cooling is performed so as not to cause the offset phenomenon. By this cooling process, a temperature range for a sheet separation is made wider in an area where the fixing is achieved in a good shape and, as a result, the fixing efficiency is improved.

In addition, by the structure in which the secured receiving roller 502 is arranged to be the driving roller and the fixing roller 506 serving as the following roller is arranged to push the fixing belt 504 against the receiving roller 502 so that the fixing process area N is formed therebetween, the driving connection from the color copying apparatus to the receiving roller 502 is made smooth. Thereby, the fixing process area N is not affected adversely by the driving torque, which problem is also described earlier. Accordingly, a desired linear velocity can stably be used during the fixing transfer operation without a decrease of the fixing efficiency.

Further, by the structure in which the fixing process area N is formed by pressing the fixing belt unit to the receiving roller 502 around the supporting roller 508 as a center upstream from the fixing roller 506, the pressure does not generate variations of the nip shape, particularly at an entrance of the fixing process area N. As a result, it prevents the recording sheet P from causing wrinkles.

Further, in the fixing station 500, as illustrated in FIG. 10, an angle θ formed between a tangent line of the heat roller 410 and the supporting roller 508 and a tangent line of the receiving roller 502 is set to a value in a range of from 15 degrees to 70 degrees. By setting the angle θ to 15 degrees or greater, the fixing belt 504 is prohibited from touching the recording sheet P before it enters the fixing process area N and does not cause the problem of the rubbing toner image even when the recording sheet P is curled. By setting the angle θ to 70 degrees or smaller, a contact area of the fixing belt 504 with the supporting roller 508 becomes comparatively greater and, therefore, the heat shift from the fixing belt 504 to the supporting roller 508 is made smaller. Thus, the loss of heat due to the existence of the supporting roller 508 is reduced.

In addition, since the surface elastic layer of the receiving roller 502 has a high releasing property and a thin thickness of 200 μm or less, the receiving roller 502 has a relatively-high accuracy of its outside shape which will not be changed over time. Accordingly, such a receiving roller 502 is superior in reproducing a desired velocity and in maintaining the desired velocity in a stable manner. Further, because of the high releasing type elastic layer, the receiving roller 502 is superior in eliminating the problems of the offset and the uneven glossy finish in the fixing of the color image or of the double-sided duplication.

Figure 16:
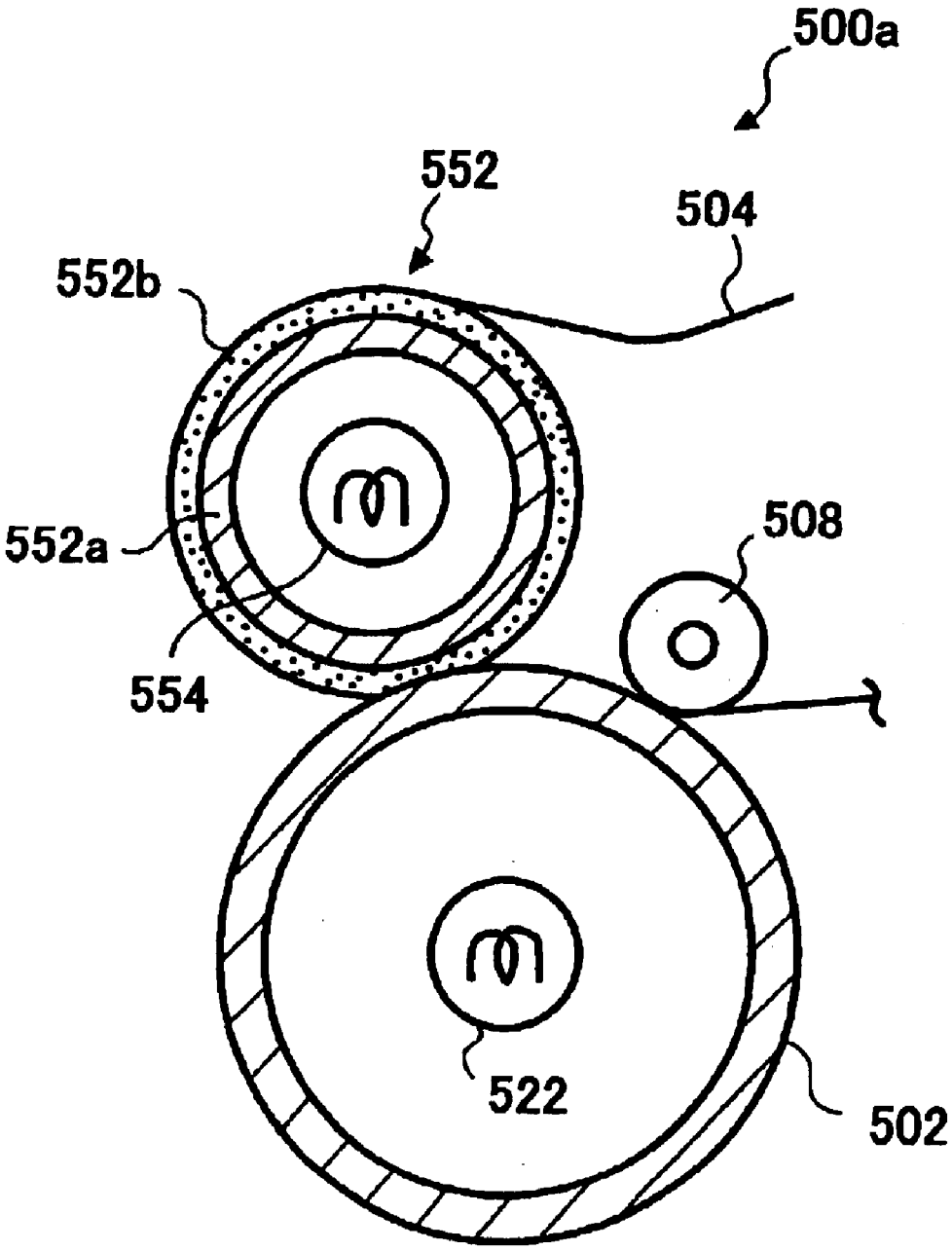
FIG. 16 is a cross-sectional view of a major portion of a variation model of the fixing station of FIG. 10.

Next, a variation model based on the fixing station 500 is explained with reference to FIG. 16. FIG. 16 shows a major portion of the variation model, a fixing station 500*a*, which is similar to the fixing station 500 of FIG. 10, except for a fixing roller 552. The fixing roller 552 includes a metal core 552*a* made of aluminum, electroformed-iron, or the like and an elastic layer 552*b* for serving as a hard elastic layer made of solid silicone rubber of a good heat-conductivity and which covers the surface of the metal core 552*a*. In addition, the fixing roller 552 internally includes a halogen heater 554 as a second fixing heat source.

In the case of the fixing station 500 of FIG. 10, the fixing roller 506 includes, as described above, the silicone-foam-made thick elastic layer 506*b* having the relatively low heat conductivity. With this low conductivity, it is aimed to avoid an event that the fixing belt 504 loses heat to the fixing roller 506 to the extent that the fixing process is not properly performed. However, the thick elastic layer 506*b* may be deteriorated over time due to its nature and, when it is deteriorated, the fixing roller 506 may rotate unevenly and cause a faulty result of the fixing process.

The fixing station 500*a* is aimed to prevent this event by the elastic layer 552*b* and the halogen heater 554. That is, the elastic layer 552*b* is free from deterioration over time due to the hardness of the solid silicone rubber. Further, the issue of the heat transfer from the fixing belt 504 to the fixing roller 506 due to the good heat-conductivity of the elastic layer 552*b* is resolved by the equilibrium in temperature achieved by heating the fixing roller 506 with the halogen heater 554. For this purpose, the halogen heater 554 is controlled to generate heat at a certain temperature by a control mechanism (not shown) so that the fixing belt 504 does not lose heat more than necessary to the fixing roller 506 and that the cooling effect, which is an advantage of the belt-type fixing process because it prevents the offset phenomenon, can still be obtained during the fixing process.

Figure 2:
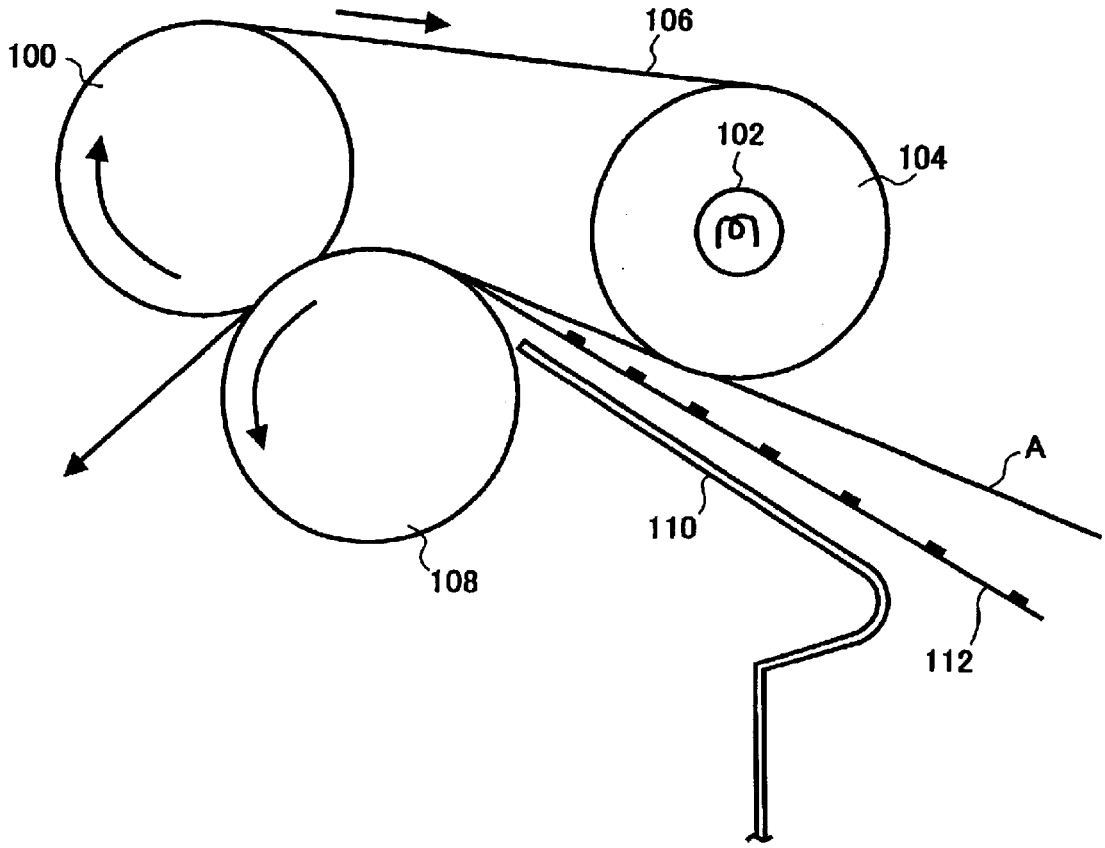
FIG. 2 PRIOR ART
FIG. 2 is a schematic representation of the prior art fixing station of FIG. 1, in which a recording sheet is caused to touch the fixing belt due to a trailing edge rise phenomenon.
Figure 17:
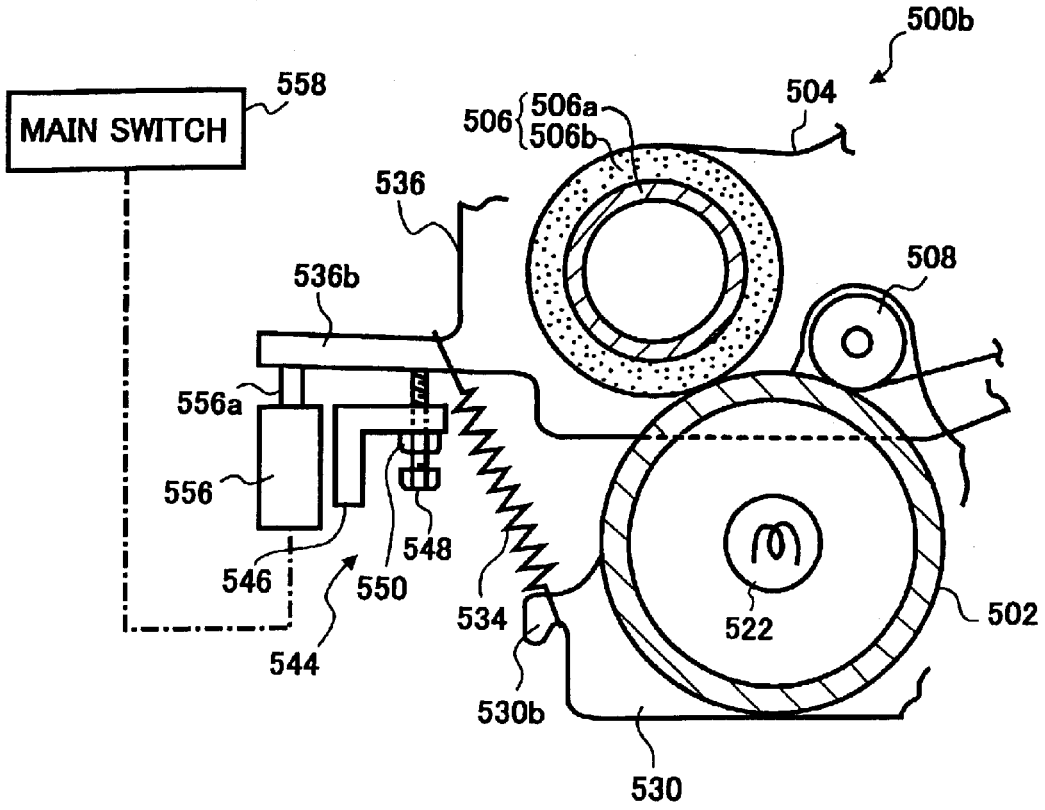
FIG. 17 is a cross-sectional view of another variation model of the fixing station of FIG. 10, at a state that a fixing roller pushes a receiving roller.
Figure 18:
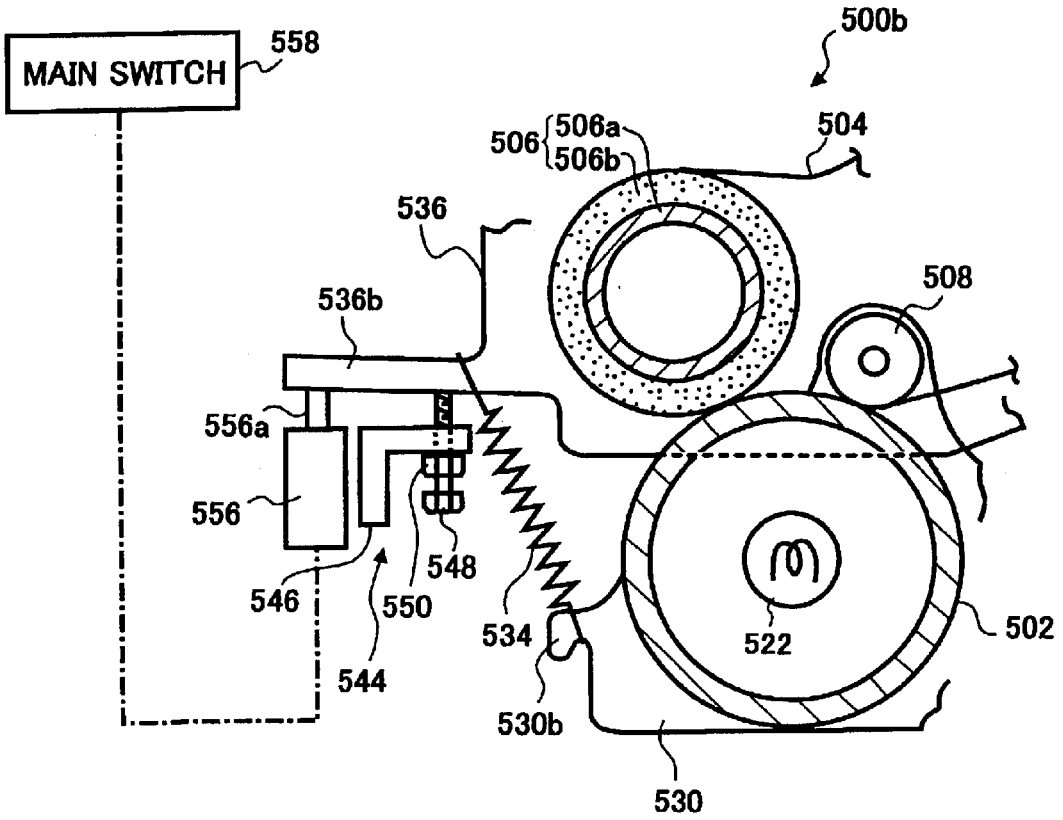
FIG. 18 is another cross-sectional view of the variation model of FIG. 17, at a state that the fixing roller is separated from the receiving roller.

Next, another variation model based on the fixing station 500 of FIG. 2 is explained with reference to FIGS. 17 and 18. FIG. 17 shows a major portion of the variation model, a fixing station 500*b*, which is similar to the fixing station 500 of FIG. 10, except for a solenoid 556. In the fixing station 500 of FIG. 10, if the fixing roller 506 is kept under pressure even during the time when the color copying apparatus is on standby, the elastic layer 506*b* of the fixing roller 506 would cause a permanent deformation which leads to a faulty result of the fixing process. The fixing station 500*b* is aimed to resolve this issue by releasing the fixing roller 506 from the pressure when the color copying apparatus is on standby.

The hook 536*b* of the bracket 536, hooking the pressure spring 534, is configured to have an extension with which a rod 556*a* movable in the solenoid 556 makes contact. The solenoid 556 is electrically connected via a control mechanism (not shown) to a main switch 558 provided to the fixing station 500*b* or to the color copying apparatus. When the main switch 558 is turned on, the solenoid 556 is powered and the rod 556*a* is pulled into the solenoid 556 to release the hook 536*b*. Accordingly, the bracket 536 is moved downwards by the pressure spring 534 to make contact with the stopper 544, as illustrated in FIG. 17. As a result, the fixing roller 506 pushes the fixing belt 504 against the receiving roller 502.

When the main switch 558 is turned off, the solenoid 556 is turned off and the rod 556*a* is lifted so that the bracket 536 is pushed upwards against the force of the pressure spring 534. Accordingly, the fixing roller 506 is released from the pressure of the contact relative to the receiving roller 502. At the release of pressure, it is not necessarily needed to move the fixing roller 506 to a position completely apart from the receiving roller 502 but to make the separation of the fixing roller 506 from the receiving roller 502 to the extent that the elastic layer 506*b* would not cause a permanent deformation.

As an alternative to the solenoid 556, an eccentric roller or the like may be used, which is rotated manually by an operator to release the pressure. However, in the case of using the solenoid 556 associated with the operation of the main switch 558, the manual release operation by an operator is not needed and, therefore, it is avoided that the operator forgets to release the pressure.

As another alternative to the solenoid 556, any one of a cam driving mechanism, an air cylinder, and an oil cylinder may be used.

Figure 19:
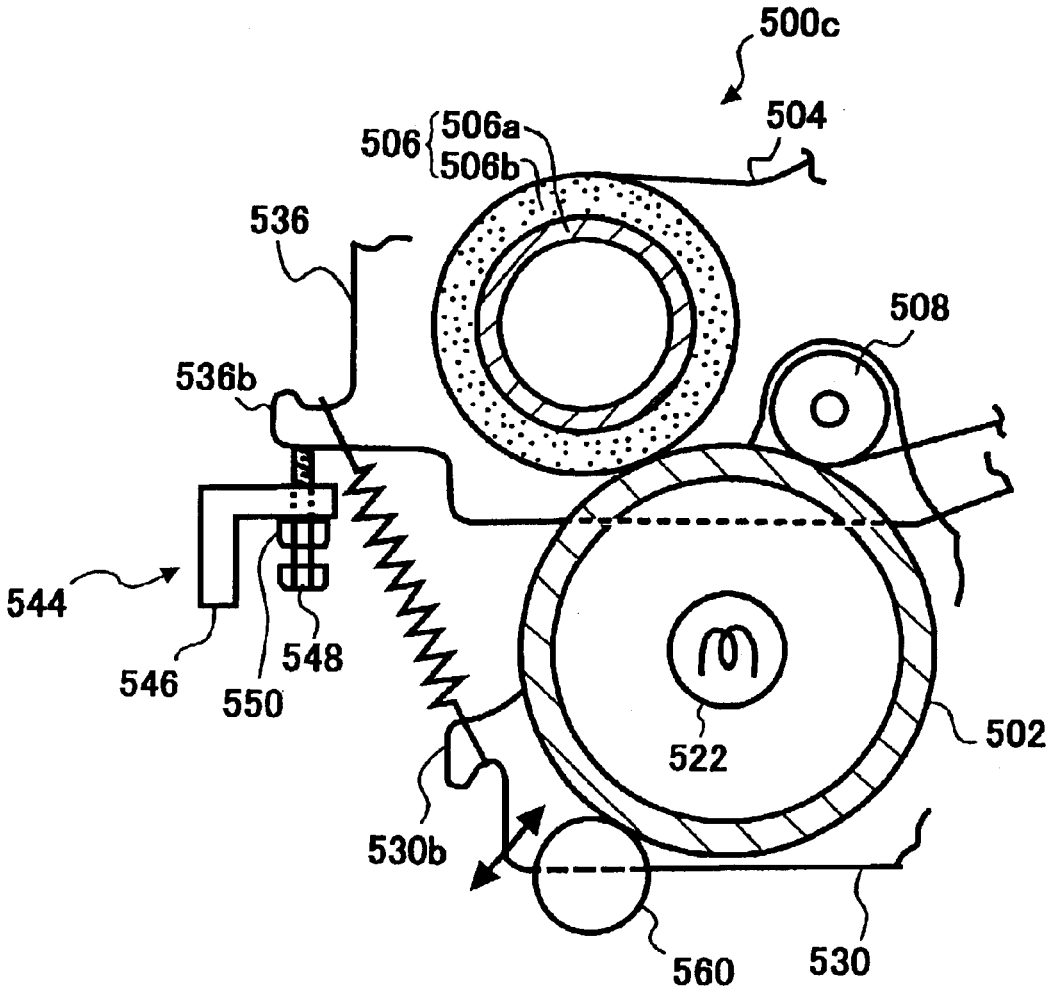
FIG. 19 is a cross-sectional view of a major portion of another variation model of the fixing station of FIG. 10.

Referring to FIG. 19, another variation model of the fixing station 500 shown in FIG. 10 is explained. FIG. 19 shows a major portion of the variation model, a fixing station 500*c*, which is similar to the fixing station 500 of FIG. 10, except for an oil-coating roller 560. The width of the fixing process area N in the fixing station 500 of FIG. 10 is relatively wide and, therefore, the recording sheet entered into the fixing process area N is prone to be curled because the fixing process area N is curved along the surface of the receiving roller 502. In particular, when the recording sheet P has images on both sides, the recording sheet P would be strongly curled during the fixing process so that it would not be separated from the receiving roller 502 in a proper manner. As a result, the recording sheet P would not be ejected from the fixing station 500.

The fixing station 500*c* of FIG. 19 is aimed to resolve this issue by improving the release property of the receiving roller 502 with the oil-coating roller 560. The oil-coating roller 560 is configured to be switched by a switch mechanism (not shown) between two positions; at one position the oil-coating roller 560 makes contact with the receiving roller 502 and at the other position it keeps a distance from the receiving roller 502. The above-mentioned switch mechanism is controlled by a control mechanism (not shown) and, when the recording sheet P has images on both sides, the oil-coating roller 560 is moved at the position in contact with the receiving roller 502 and applies a coating of a release agent to the surface of the receiving roller 502. When the recording sheet P has an image on one side, the oil-coating roller 560 is moved at the position away from the receiving roller 502.

Figure 20:
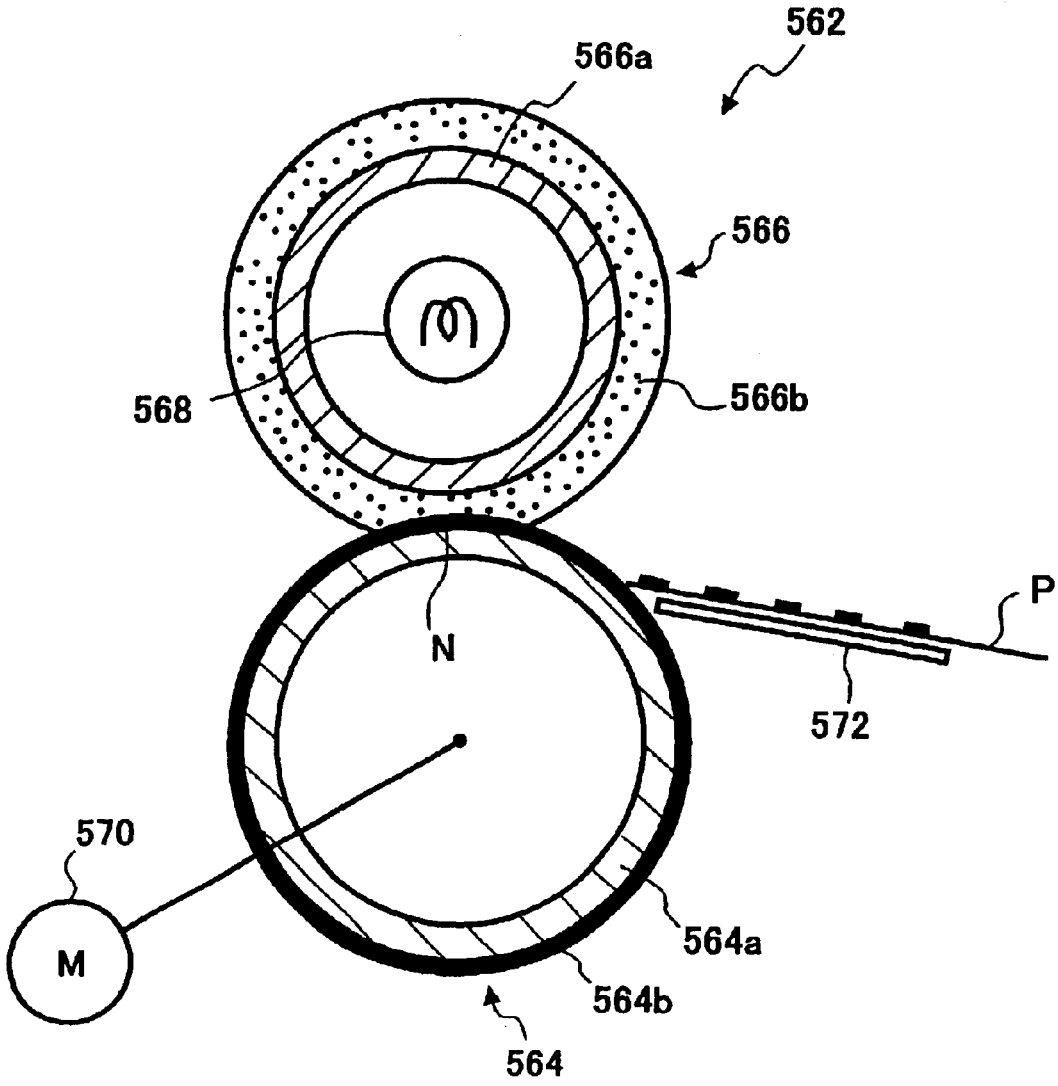
FIG. 20 is a cross-sectional view of a major portion of another fixing station according to an embodiment of the present invention.

Next, another fixing station according to an embodiment of the present invention is explained with reference to FIG. 20. FIG. 20 illustrates a fixing station 562 using a heat-roller-type fixing method. The fixing station 562 includes a receiving roller 564, a fixing roller 566, halogen heater 568, and a motor 570. Each end of the receiving roller 564 is secured to a side plate (not shown) of the fixing station 562 so that a rotating axis of the receiving roller 562 is stably fixed. The receiving roller 564 is configured to form a nip with the fixing roller 566 pressed by the receiving roller 564. The halogen heater 568 is provided inside the fixing roller 566 and is used as a heat source for heating a recording sheet P having an image thereon. The motor 570 is used to drive the receiving roller 564.

The fixing roller 566 is used as a following roller and includes a metal core made of aluminum, iron, or the like and a silicone-foam thick elastic layer 566*b* covering the surface of the metal core 566*a*. The receiving roller 564 has a stiffer structure resistant to deformation in comparison with the fixing roller 566. That is, as similar to the case of FIG. 11, the receiving roller 564 includes a 1-mm-thick tubular iron core 564*a* and a high-release-type elastic layer 564*b* covering the surface of the iron core 564*a*, wherein the elastic layer 564*b* has a thickness of 200 $\mu$m or thinner. In the fixing station 564, the elastic layer 564*b* is configured to have a thickness of 70 $\mu$m and is made of a high-release-type silicone rubber.

In the fixing station 562, a structure in which the fixing roller 566 applies pressure to the receiving roller 564 and a structure for driving the receiving roller 564 can be formed in manners similar to those of the fixing station 500 of FIG. 10. The mechanism around the stopper 544 of the fixing station 500 of FIG. 10 may also be applied to the fixing station 562 in a similar manner.

In the fixing station 562, the recording sheet P is guided by a guide plate 572 and, subsequently, by the surface of the receiving roller 564. Then, the recording sheet P is entered into the fixing process area N formed between the fixing roller 566 and the receiving roller 564 such that the image surface of the recording sheet P makes contact with the fixing roller 566 when the recording sheet P has a color image on one side, as illustrated in FIG. 20. Thus, the fixing station 562 can perform the fixing process relative to the recording sheet P having a color image, without loosing the glossy effect of toner.

Since the rotation axis of the receiving roller 564 is firmly fixed in a manner similar to the fixing station 500 of FIG. 10, the fixing station 562 is configured to prevent the jam problem which is described earlier with reference to FIG. 3. In addition, the receiving roller 564 can eliminate the variations of torque in a similar manner to the fixing station 500 of FIG. 10. Thereby, in the fixing station 562, the fixing process area N is prevented from being adversely affected. Further, such a receiving roller 564 is superior in reproducing a desired velocity and in maintaining the desired velocity in a stable manner.

Figure 21:
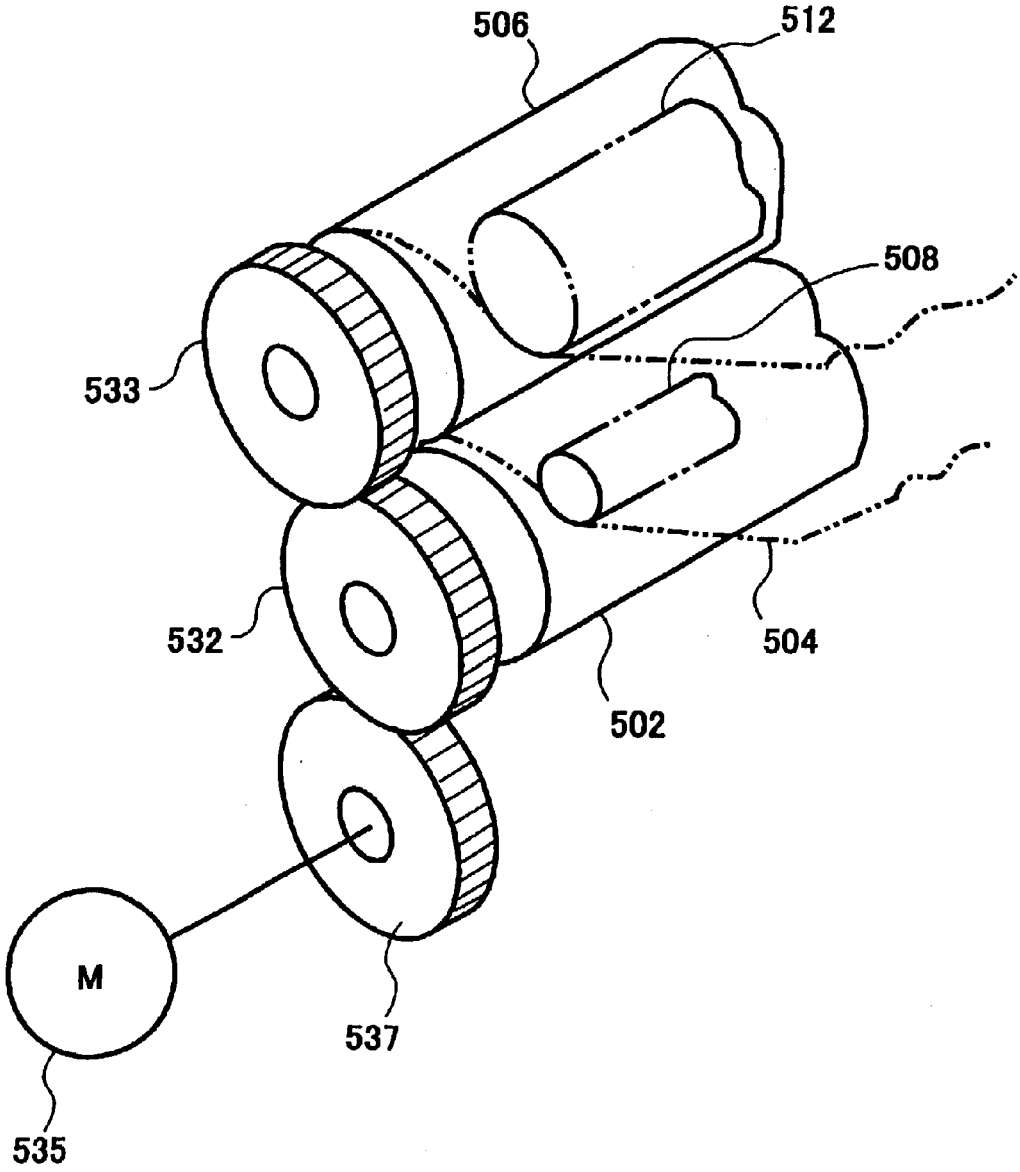
FIG. 21 is a perspective view of the major portion of the fixing station of FIG. 10 with a set of gears.

In addition, the belt-type fixing station described above may use a set of gears for transmitting a driving force from a motor, as illustrated in FIG. 21. In the fixing station 500 of FIG. 10, the receiving roller 502 is rotated by a driving source and the fixing roller 506 is rotated by the rotation of the receiving roller 502. However, as illustrated in FIG. 21, it is possible to provide a gear 532 to the end of the receiving roller 502 and a gear 533 to the end of the fixing roller 506. A driving force generated by a motor 535 is transmitted to a gear 537 which transmits the rotation to the gear 532 by which rotation the receiving roller 502 is rotated. The rotation of the receiving roller 502 is transmitted to the fixing roller 506 via the gears 532 and 533.

In the above-mentioned configuration, the diameters of the fixing roller 506 and the receiving roller 502 are needed to be equal to each other. The gear 537 may also be engaged with the gear 533 of the fixing roller 506, which configuration may be applicable to the fixing station 562 of FIG. 20.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letter Patent of the United States is:

1. A fixing apparatus, comprising:

a receiving roller configured to rotate around a rotation axis fixed at a position;

a fixing roller configured to apply a pressure to said receiving roller so that a fixing nip area is formed between said fixing roller and said receiving roller, said fixing roller having an elastic layer;

a heat source provided within said fixing roller and adapted to apply heat to a recording sheet carrying an image on a surface thereof; and a driving source configured to rotate at least one of said fixing roller and said receiving roller, wherein the recording sheet is conveyed to said fixing nip area in an orientation in which the surface carrying the image faces said fixing roller and another surface of the recording sheet carrying no image faces said receiving roller, wherein said receiving roller comprises a hard-metal core and a high-release elastic layer covering said hard-metal core, and wherein said high-release elastic layer has a thickness of at most 200 $\mu$m.

2. A fixing apparatus as defined in claim 1, wherein said receiving roller has a structure resistant to deformation in comparison with a structure of said fixing roller, and the recording sheet is guided at a leading edge thereof by a surface of said receiving roller to enter said fixing nip area.

3. A fixing apparatus as defined in claim 1, wherein said receiving roller is rotated by said driving source and said fixing roller is rotated due to contact with said receiving roller.

4. A fixing apparatus as defined in 1, further comprising a pressure applying member configured to apply a pressure to said fixing roller so that said fixing roller pushes said receiving roller.

5. A fixing apparatus as defined in claim 4, further comprising a stopper configured to stop at a predetermined position said fixing roller from being moved towards said receiving roller by said pressure applying member.

6. A fixing method, comprising the steps of:

fixing at a position a rotation axis of a receiving roller having a deformation-resistant structure, said receiving roller including a hard-metal core and a high-release elastic layer covering said hard-metal core, and said high-release elastic layer having a thickness of at most 200 $\mu$m;

applying a pressure to a fixing roller to push said receiving roller so that a fixing nip area is formed between said fixing roller and said receiving roller;

rotating said receiving roller such that said fixing roller follows in rotation;

conveying a recording sheet carrying an image on a surface thereof into said fixing nip area in an orientation in which said surface carrying said image faces said fixing roller and another surface of said recording sheet carrying no image faces said receiving roller; and performing a fixing process using said fixing roller to apply heat and pressure to said recording sheet.

7. A fixing method, comprising the steps of:

fixing at a position a rotation axis of a receiving roller having a deformation-resistant structure, said receiving roller including a hard-metal core and a high-release elastic layer covering said hard-metal core, and said high-release elastic layer having a thickness of at most 200 $\mu$m;

applying a pressure to a fixing roller and a fixing belt wound around a surface of said fixing roller to push said receiving roller so that a fixing nip area is formed between said fixing roller and said fixing belt;

rotating said receiving roller such that said fixing roller follows in rotation;

conveying a recording sheet carrying an image on a surface thereof into said fixing nip area in an orientation in which said surface carrying said image contacts said fixing belt and another surface of said recording sheet carrying no image contacts said receiving roller; and performing a fixing process using said fixing roller to apply heat and pressure to said recording sheet.

8. A fixing method as defined in claim 7, further comprising the steps of:

providing at least two supporting rollers inside said fixing belt to support said fixing belt together with said fixing roller;

unifying said at least two supporting rollers, said fixing roller, and said fixing belt into one fixing unit;

holding said fixing unit for a turning movement about a rotation axis of one of said at least two supporting rollers, located upstream from said fixing nip area in a direction of transferring said recording sheet; and turning said fixing unit to apply said pressure to said fixing roller.

9. An image forming apparatus, comprising:

an image forming station adapted to form an image on a recording sheet;

a sheet transfer mechanism adapted to transfer the recording sheet carrying an image on a surface thereof; and a fixing station configured to perform a fixing process with heat and pressure, said fixing station comprising:

a receiving roller configured to rotate around a rotation axis fixed at a position and to receive the recording sheet carrying an image on a surface thereof;

a fixing roller configured to apply a pressure to said receiving roller so that a fixing nip area is formed between said fixing roller and said receiving roller, said fixing roller having an elastic layer;

a heat source provided within said fixing roller and configured to apply heat to the recording sheet;

a driving source configured to rotate at least one of said fixing roller and said receiving roller, wherein the recording sheet is conveyed to said fixing nip area in an orientation in which the surface of the recording sheet carrying the image faces said fixing roller and another surface of the recording sheet carrying no image faces said receiving roller, wherein said receiving roller comprises a hard-metal core and a high-release elastic layer covering said hard-metal core, and wherein said high-release elastic layer has a thickness of at most 200 $\mu$m.

10. An image forming apparatus as defined in claim 9, wherein said receiving roller has a structure resistant to deformation in comparison with a structure of said fixing roller, and wherein the recording sheet is guided at a leading edge thereof by a surface of said receiving roller to enter said fixing nip area.

11. An image forming apparatus as defined in claim 10, wherein said receiving roller is rotated by said driving source and said fixing roller follows a rotation of said receiving roller.

12. An image forming apparatus as defined in claim 9, further comprising a pressure applying member configured to apply a pressure to said fixing roller so that said fixing roller pushes said receiving roller.

13. An image forming apparatus as defined in claim 12, further comprising a stopper configured to stop at a predetermined position said fixing roller from being moved towards said receiving roller by said pressure applying member.

* * * * *